US010421293B2

(12) United States Patent
Tanio et al.

(10) Patent No.: US 10,421,293 B2
(45) Date of Patent: Sep. 24, 2019

(54) TABLET PRINTING APPARATUS AND TABLET MANUFACTURING METHOD

(71) Applicant: Shibaura Mechatronics Corporation, Kanagawa (JP)

(72) Inventors: Noritsugu Tanio, Yokohama (JP); Jumpei Tanaka, Yokohama (JP); Norihito Mafune, Yokohama (JP); Junsuke Komito, Yokohama (JP)

(73) Assignee: SHIBAURA MECHATRONICS CORPORATION, Yokohama-Shi, Kanagawa (JP)

( * ) Notice: Subject to any disclaimer, the term of this patent is extended or adjusted under 35 U.S.C. 154(b) by 0 days.

(21) Appl. No.: 16/040,948

(22) Filed: Jul. 20, 2018

(65) Prior Publication Data

US 2018/0326747 A1 Nov. 15, 2018

Related U.S. Application Data

(63) Continuation of application No. PCT/JP2017/003062, filed on Jan. 27, 2017.

(30) Foreign Application Priority Data

Jan. 29, 2016 (JP) ..... 2016-016730

(51) Int. Cl.
*B41J 3/407* (2006.01)
*B41M 5/00* (2006.01)
(Continued)

(52) U.S. Cl.
CPC ..... *B41J 3/4073* (2013.01); *A61J 3/007* (2013.01); *A61J 3/06* (2013.01); *B41M 5/0088* (2013.01); *B41F 17/36* (2013.01)

(58) Field of Classification Search
CPC combination set(s) only.
See application file for complete search history.

(56) References Cited

U.S. PATENT DOCUMENTS

2014/0168309 A1* 6/2014 Morita ..... B41J 3/407 347/16

FOREIGN PATENT DOCUMENTS

| | | | |
|---|---|---|---|
| JP | 7-81050 | A | 3/1995 |
| KR | 10-2015-0015379 | A | 2/2015 |
| WO | 2009/025371 | A1 | 2/2009 |

OTHER PUBLICATIONS

International Search Report dated Apr. 25, 2017 in corresponding International Application No. PCT/JP2017/003062.

* cited by examiner

*Primary Examiner* — Thinh H Nguyen
(74) *Attorney, Agent, or Firm* — Nath, Goldberg & Meyer; Jerald L. Meyer

(57) ABSTRACT

A tablet printing apparatus and a tablet manufacturing method are provided which are capable of distinguishing and collecting a preceding tablet and a following tablet from each other when two or more tablets in contact with each other are carried. A tablet printing apparatus includes a carrying device 20 carrying tablets Tb, a sensor 30 detecting the tablet Tb being carried by the carrying device 20, a printing unit 50 performing, when the status changes from the status in which the sensor 30 the tablet Tb is not detected to the status in which the tablet Tb is detected, printing on the tablet Tb that has changed the status, and a collecting unit R distinguishing and collecting, when the time length at which the sensor 30 is detecting the tablet Tb is longer than the predetermined setting value because two or more tablets Tb in contact with each other are carried, the preceding (Continued)

tablet Tb and the following tablet Tb following thereto among two or more tablets Tb.

10 Claims, 12 Drawing Sheets

(51) Int. Cl.

| | |
|---|---|
| ***A61J 3/06*** | (2006.01) |
| ***A61J 3/00*** | (2006.01) |
| *B41F 17/36* | (2006.01) |

TABLET PRINTING APPARATUS AND TABLET MANUFACTURING METHOD

CROSS-REFERENCE TO RELATED APPLICATION

This application is a Continuation of PCT Application No. PCT/JP2017/003062, filed on Jan. 27, 2017, and claims priority to Japanese Patent Application No. 2016-016730, filed on Jan. 29, 2016, the entire contents of both of which are incorporated herein by reference.

TECHNICAL FIELD

The present disclosure relates to a tablet printing apparatus and a tablet manufacturing method.

BACKGROUND ART

Conventionally, the tablet printing apparatus disclosed in the Patent Documents 1 is known. This tablet printing apparatus carries tablets in sequence by a carrying belt. Moreover, a character, a marking, etc., for identification are printed on a surface of the tablet by an inkjet printing device that is a printing device provided so as to face the tablet on the carrying belt.

The inkjet printing device includes a nozzle head that has a plurality of nozzles which ejects ink droplets. The plurality of the nozzles of the nozzle head perform printing by ejecting ink droplets in accordance with a pattern based on printing data.

Utilization of such an inkjet printing device enables a quick compliance even when the character and the marking to be printed are changed due to a change in kind of the tablet, etc., by changing the printing data to be provided. Moreover, utilization of the inkjet printing device enables a non-contact printing. For this reason, it is sanitary, and is suitable when the tablet that is a printing object is for drinking.

Furthermore, a plurality of small holes is formed in the carrying belt along the carrying direction, air is sucked via such small holes to suck and hold the tablets, and printing is performed in a condition in which the tablet is stabilized.

SUMMARY OF INVENTION

Technical Problem

According to such a printing apparatus, a sensor detects an arrival of tablet carried by the carrying belt, and then a subsequent process is performed. However, depending on the direction, inclination, and position, etc., of the tablet, the printing may not be performed properly. Hence, continuously imaging by a camera a large amount of tablets moving in sequence and analyzing the moving image to check the posture of the tablets are considered, but such processes has a large process load, and is difficult for fast-speed processing. Accordingly, the sensor provided at the upstream side relative to the camera detects the arrival of the tablet, and a still image is imaged at a timing at which the detected tablet enters the imaging region of the camera, enabling a grasp of the posture of the tablets in various conditions by fast-speed processing using minimum quantity of images.

Here, there is a case the tablets are be dropped and supplied in sequence to the carrying belt from the upper space of the surface thereof. When the tablet is sucked and held on the carrying belt, the tablets dropped onto the surface of the carrying belt are sucked by the small hole, and arranged in a line in the carrying direction. At this time, when the tablets are sucked one by one with intervals in between, since the sensor can detect the arrivals of each tablet, printing can be performed one by one on each tablet based on this detection, enabling a manufacturing of the tablet on which a character or a marking for identification is printed.

However, there is a case tablets are carried in contact with each other without intervals. When two or more tablets in contact with each other are carried, some sensors cannot detect the boundary between tablets. Hence, the tablets following to the preceding tablet are not recognized by an apparatus, and processes, such as imaging, printing, and inspection, cannot be performed. Moreover, the tablet not recognized by the apparatus cannot be ejected as a defective product, and may be mixed with tablets that is in non-defective product. This requires another selection, etc., and the productivity is decreased.

The present disclosure has been proposed in order to address the foregoing technical problems, and an objective is to provide a tablet printing apparatus and a tablet manufacturing method capable of distinguishing and collecting a preceding tablet and following tablets when two or more tablets in contact with each other are carried.

Solution to Problem

In order to achieve the above objective, a tablet printing apparatus according to the present disclosure includes:

a carrying device that carries tablets;

a detecting unit that detects the tablet being carried by the carrying device;

a printing unit that performs, when a status of the detecting unit changes from the status in which the tablet is not detected to the status in which the tablet is detected, printing on the tablet that has changed the status; and a collecting unit that distinguishes and collects, when a detection value of the detecting unit exceeds a predetermined setting value because two or more tablets in contact with each other are carried, a preceding tablet and following tablets thereto among two or more tablets.

The tablet printing apparatus may include an ejection determining unit that determines, the following tablet following the preceding tablet as the tablet to be ejected, in which the collecting unit may include an ejecting device that ejects the tablet determined as the tablet to be ejected by the ejection determining unit.

The tablet printing apparatus may include an ejection calculating unit that obtains, based on the detection value of the detecting unit, a reference value for a process of ejecting the tablet by the ejecting device. The tablet printing apparatus may include an ejection calculating unit that calculates, based on the detection value of the detecting unit, a number of the tablets to be ejected by the ejecting device.

The tablet printing apparatus may include:

an imaging unit that images the tablet being carried by the carrying device at least either before or after the printing by the printing unit; and an defect determining unit that determines whether the tablet is a defective product or not based on image data imaged by the imaging unit, in which the collecting unit may include a collecting device that distinguishes and collects the tablet determined to be ejected by the ejection determining unit, a non-defective product, and the tablet determined as a defective product by the defect determining unit.

The tablet printing apparatus may include:

an imaging unit that images the tablet being carried by the carrying device; and a setting value determining unit that determines the setting value based on image data imaged by the imaging unit.

A tablet manufacturing method according to the present disclosure includes:

causing a printing unit to perform, when a status of a detecting unit that detects a tablet being carried by a carrying device changes from the status in which the tablet is not detected to the status in which the tablet is detected, printing on the tablet that has changed the status; and distinguishing and collecting, when a detection value of the detecting unit after the status is changed exceeds a predetermined setting value, the tablet that has changed the status and the tablet at a position corresponding to the detection value exceeding the setting value.

Moreover, the tablet manufacturing method may include: imaging the tablet that has changed the status; and determining the setting value based on imaged image data.

Advantageous Effects of Invention

According to the present disclosure, provided are a tablet printing apparatus and a tablet manufacturing method which are capable of distinguishing and collecting a preceding tablet and a following tablet when two or more tablets in contact with each other are carried.

DESCRIPTION OF EMBODIMENTS

An embodiment of the present disclosure (referred to as an "embodiment" below) will be described below with reference to the figures.

[Printing Object]

A tablet printing apparatus S handles tablets Tb as a printing object. Example tablets Tb are a bare tablet (plain tablet), a sugar coating tablet, a film coating tablet (FC tablet), an enteric coating tablet, a gelatin coating tablet, a multi-layer tablet, and a nucleated tablet. Moreover, the tablet Tb also include capsule tablets, such as a hard capsule and a soft capsule. The application of such a tablet Tb is for medicines, food, detergents, industry, etc., and is not limited to any particular application.

[Tablet Printing Apparatus]

Figure 1:
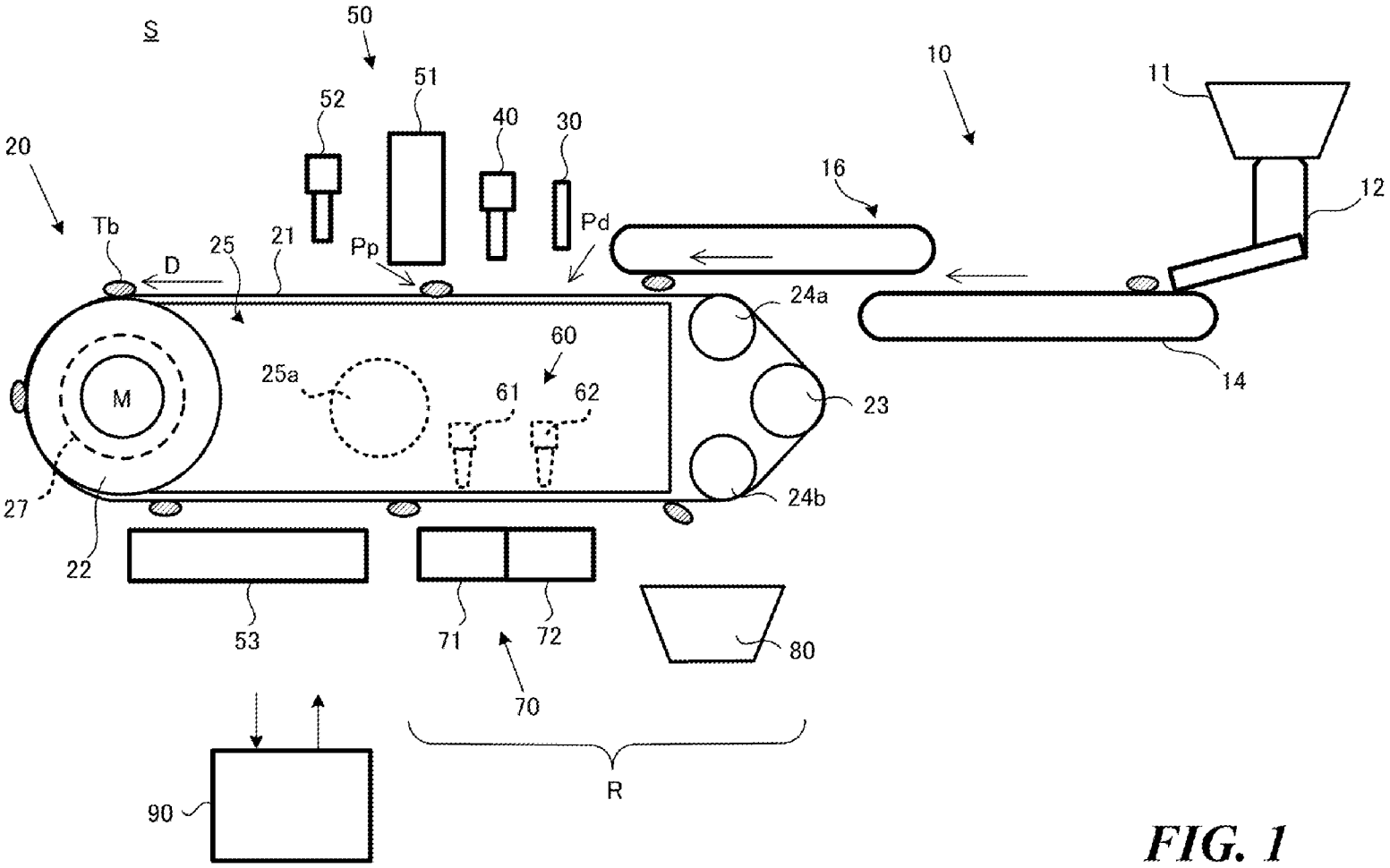
FIG. 1 is a diagram schematically illustrating an entire structure of a tablet printing apparatus according to an embodiment.

The tablet printing apparatus S according to this embodiment will be described with reference to FIG. 1. The tablet printing apparatus S includes a supplying device 10, a carrying device 20, a sensor 30, a camera 40, a printing unit 50, an ejecting device 60, a collecting device 70, a storing device 80, and a control device 90. In this embodiment, the ejecting device 60, the collecting device 70, and the storing device 80 form a collecting unit R. The collecting unit R distinguishes and collects, when a detection value of the sensor 30 exceeds a preset setting value because two or more tablets in contact with each other are carried, a preceding tablet Tb and following tablets Tb following the preceding tablet Tb among two or more tablets Tb. Specific structures of those devices will be described below in detail. The detection value of the sensor 30 is a value that indicates the sequential quantity from the detection of the tablet Tb by the sensor 30, and is, for example, a length of time (referred to as a time length below). Moreover, the setting value is a reference value to be compared with the detection value detected by the sensor 30, and is also a time length when the detection value is the time length.

[Supplying Device]

The supplying device 10 is a device that supplies the tablet Tb to the carrying device 20. The supply device 10 includes a hopper 11, a vibration feeder 12, an aligning feeder 14, and a transfer feeder 16.

The hopper 11 is a container that stores the tablets Tb. The vibration feeder 12 is a carrying path that moves the tablets Tb ejected in sequence from the hopper 11 toward the aligning feeder 14. The vibration feeder 12 is provided with an unillustrated vibrator. The tablet Tb is moved by vibration applied by the vibrator to the vibration feeder 12. The vibration feeder 12 has a path in a perpendicular direction at the hopper-11 side, and a path inclined and extended to the aligning feeder 14.

The aligning feeder 14 receives the tablet Tb from the vibration feeder 12, and feeds the received tablet to the transfer feeder 16. The carrying belt is wound around two pulleys that are rotated by an unillustrated drive source. Aligning guides are provided on the carrying path of the carrying belt. The aligning guides divide and aligns the tablets Tb, for example, into two rows, and carry the tablet Tb in each row toward the transfer feeder 16 in sequence.

The transfer feeder 16 has a carrying belt with sucking hole, and the carrying belt is wound around two unillustrated pulleys. A sucking chamber coupled to an unillustrated sucking device is provided inwardly to the carrying belt.

The transfer feeder 16 is installed over the upper space of the rear end of the aligning feeder 14 and the upper space of the front end of the carrying device 20.

The carrying belt of the transfer feeder 16 receives the tablet Tb from the aligning feeder 14 by the sucking action of the sucking chamber. The carrying belt of the transfer feeder 16 that has received the tablet Tb feeds the tablet Tb to the carrying device 20 at a position where the sucking action of the sucking chamber is no longer active. Accordingly, when the supplying device 10 feeds the tablet Tb to the carrying device 20, two or more tablets Tb may contact with each other.

[Carrying Device]

The carrying device 20 is a device that carries the tablets Tb. The carrying device 20 is installed at the downstream side of the aligning feeder 14. The carrying device 20 includes a carrying belt 21, a drive pulley 22, a tension pulley 23, two adjustment pulleys 24*a* and 24*b*, a sucking chamber 25, and an encoder 27. The carrying belt 21 is a belt that carries the tablets Tb by moving the sucked and held tablet Tb. The carrying belt 21 is an endless belt, and is wound around the drive pulley 22, the tension pulley 23, and the two adjustment pulleys 24*a* and 24*b*. In the following description, in the carrying device 20, the position where the carried tablet Tb passes through first will be referred to as an upstream side, while the position where the tablet passes through afterwards will be referred to as a downstream side. The upstream side and the downstream side are inverted at upper side of the endless carrying belt 21 and at the lower side thereof.

Figure 2:
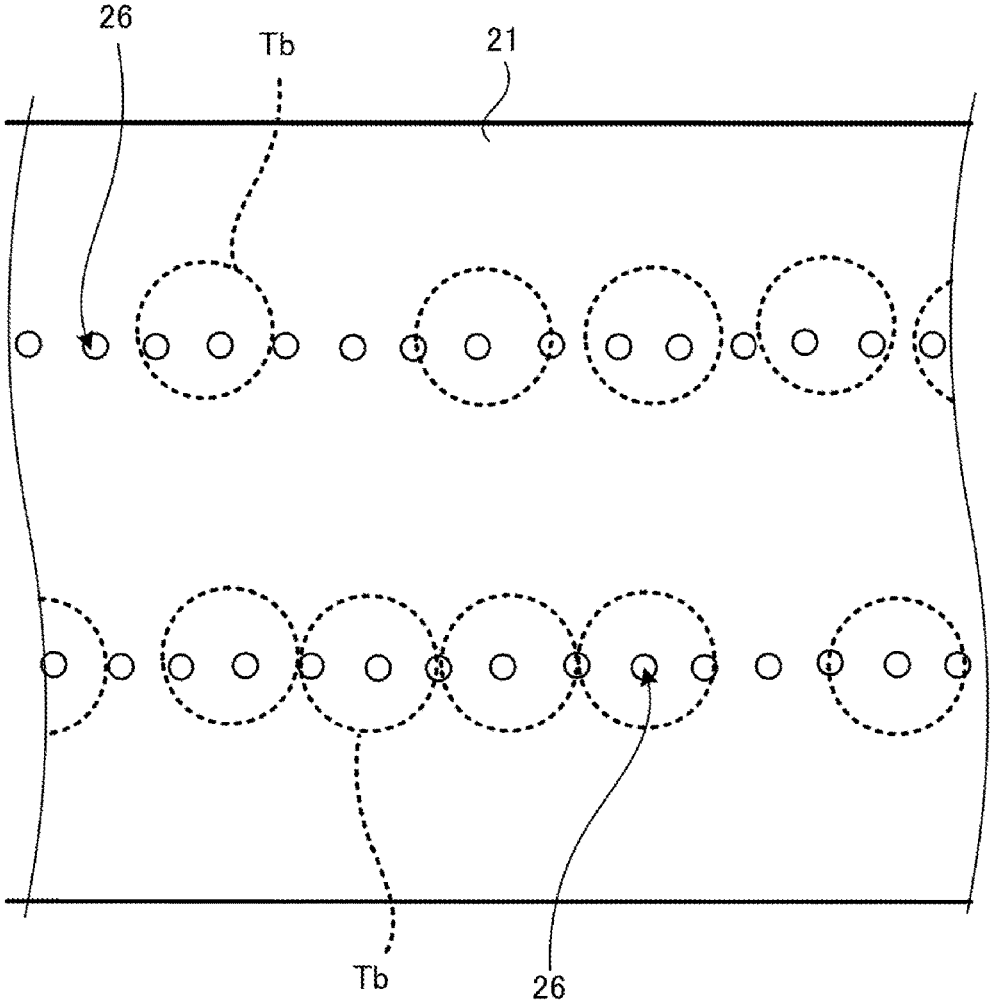
FIG. 2 is a diagram illustrating a status of a tablet placed on a carrying belt as viewed in a planar direction.

As illustrated in FIG. 2, the carrying belt 21 is provided with a plurality of communication holes 26. The plurality of air communication holes 26 are formed at a predetermined pitch in the moving direction of the carrying belt 21. As will be described later, by causing air to pass through the communication holes 26, the tablets Tb indicated by dotted line circles in the figure are sucked and held on the carrying belt 21. Depending on the condition fed from the supplying device 10, as illustrated in one of the row in FIG. 2, two or more tablets Tb are in contact with each other, and sucked and carried by the carrying belt 21 in this condition.

The drive pulley 22 is rotated by a motor M. The rotation of the drive pulley 22 drives the carrying belt 21. Although it is not illustrated in the figure, the drive pulley includes two pulleys installed in parallel at a predetermined pitch in the widthwise direction orthogonal to the carrying direction of the carrying belt 21.

The tension pulley 23 is provided so as to be movable in the horizontal direction. By adjusting the position of the tension pulley 23 in the horizontal direction, the tension of the carrying belt 21 is adjusted. The two adjustment pulleys 24*a* and 24*b* are provided so as to be independently movable in the up-and-down direction. The height of the horizontal part of the carrying belt 21 at the upper side and the horizontal part thereof at the lower side are adjusted by the two adjustment pulleys 24*a* and 24*b*.

The sucking chamber 25 sucks from the back side of the carrying belt 21 via the communication holes 26 to suck and hold the tablets Tb on the surface of the carrying belt 21. In order to enable this sucking action, an unillustrated air sucking device such as a vacuum pump is coupled to a discharge port 25*a* formed in a predetermined part of the sucking chamber 25.

The sucking chamber 25 is roughly in a box shape, and is provided inwardly to the annular carrying belt 21. The sucking chamber 25 is installed in between the two pulleys of the drive pulley 22. Holes, which the shafts of the two pulleys of the drive pulley 22 freely rotatably pass through, are formed in the sucking chamber 25 while maintaining airtightness of the sucking chamber 25.

In such a sucking chamber 25, the planar upper wall part that faces the carrying belt 21 tensioned between the drive pulley 22 and the adjustment pulley 24*a* will be referred to as an upper wall. In addition, the planar lower wall part that faces the carrying belt 21 tensioned between the drive pulley 22 and the adjustment pulley 24*b* will be referred to as a lower wall. Still further, the curved wall part in an arc shape installed in between the two pulleys of the drive pulley 22 and facing the carrying belt 21 will be referred to as a drive-pulley-22-side wall. Moreover, an end opposite to the curved wall part in an arc shape of the sucking chamber 25 is closed by a wall that faces the two adjustment pulleys 24*a* and 24*b*. Each wall of the sucking chamber 25 other than the wall that faces the adjustment pulleys 24*a* and 24*b* are provided with a plurality of sucking holes.

A sucking inside the sucking chamber 25 is performed by the sucking action by the sucking device coupled via the discharge port 25*a*. Hence, air is sucked via the sucking holes of each wall of the sucking chamber 25, and further via the communication holes 26 of the carrying belt 21, and the tablets Tb are sucked and held on the surface of the carrying belt 21.

By adjusting the position of the adjustment pulley 24*a* in the up-and-down direction, the clearance between the upper part of the carrying belt 21 and the wall of the sucking chamber 25 is adjusted. Moreover, by adjusting the position of the adjustment pulley 24*b* in the up-and-down direction, the clearance between the lower part of the carrying belt 21 and the wall of the sucking chamber 25 is adjusted. Respective adjustments of these clearances and tension of the carrying belt 21 are performed by adjusting the positions of the adjustment pulleys 24*a* and 24*b*, and the tension pulley 23

The encoder 27 is a rotary encoder that operates along with the rotation of the drive shaft of the motor M. In order to identify the position of the tablet Tb, the encoder 27 outputs the count value of encoder pulses after the tablet Tb passes through the reference position. The type of the encoder 27 is not limited to any particular type as long as it is applicable to identify the position of the tablet Tb.

[Sensor]

The sensor 30 is a detecting unit that detects the presence and absence of the tablet Tb being carried by the carrying device 20. When the status of the sensor 30 changes from the status not detecting the tablet Tb being carried by the carrying device 20 to the status detecting the tablet Tb, the output signal changes from OFF to ON. In addition, while the sensor 30 is detecting the tablet Tb, the output signal is maintained as ON. Furthermore, when the sensor 30 is not detecting the tablet Tb, the output signal changes from ON to OFF.

A reflection type optical sensor such as laser sensor is applicable as the sensor 30. The sensor 30 detects a distance from the sensor 30 to the detection target, and outputs the output signal in accordance with this detected distance. For example, the sensor 30 detects a distance from the sensor 30 to the surface of the carrying belt 21, and a distance from the sensor 30 to the surface of the tablet Tb. The term "from the sensor 30" means "from a predetermined reference position", and is different for each arithmetic processing scheme for distance of the sensor. For example, although the sensor lower surface can be taken as the predetermined reference position, the present disclosure is not limited to this case.

Although the output signal of the sensor 30 may be an analog signal in accordance with the detected distance, in this embodiment, the output signal of the sensor 30 is a digital signal that changes ON and OFF in accordance with the detected distance. That is, when the detected distance exceeds a predetermined threshold, the output signal of the sensor 30 is OFF indicating that the tablet Tb is not present. When the detected distance is equal to or smaller than the threshold, the output signal of the sensor 30 is changed from OFF to ON indicating that the tablet Tb is present. When the detected distance maintains as being equal to or smaller than the threshold, the output signal of the sensor 30 maintains as ON indicating that the tablet Tb is being present. When the detected distance exceeds the threshold, the output signal of the sensor 30 changes from ON to OFF indicating that the tablet Tb is no longer present.

The comparison with the threshold may be an amplitude value of a waveform in accordance with the distance to be detected. This amplitude value corresponds to the thickness of the tablet Tb at the position which the laser passes through. Hence, in this case, the output signal of the sensor 30 changes from OFF to ON when the amplitude value exceeds the threshold, and changes from ON to OFF when the amplitude value is equal to or smaller than the threshold.

The sensor 30 detects the presence and absence of the tablet Tb at a tablet detection position Pd at the upstream side in the carrying direction of the tablet Tb relative to a printing position Pp of the carrying belt 21. As described above, the output signal of the sensor 30 is ON while the presence of the tablet Tb is being detected, and becomes OFF level the tablet Tb is no longer detected. When the output signal of the sensor 30 is being ON for a time exceeding the passing time of one tablet Tb, this indicates that two or more tablets Tb are in contact with each other continuously.

[Camera]

The camera 40 is an imaging unit that images the tablet Tb before printing. The camera 40 images the tablet Tb that has changed the output signal of the sensor 30 from OFF to ON at a timing at which the entire tablet enters the imaging region. More specifically, imaging is performed at a timing at which the center of the tablet Tb comes in the center of the imaging region. The imaging region is the region where the imaging unit can image an image, and is also referred to as a viewing region. In this embodiment, the camera 40 images an image at a timing based on a trigger signal to be described later. When the output signal of the sensor 30 is being ON for a time exceeding the passing time of one tablet Tb, the camera 40 images only the image of the preceding tablet Tb, and does not image the image of the following tablet Tb (this will be described later in detail).

The camera 40 images the image of the tablet Tb at the upstream side relative to the printing unit 50, and checks the posture of the tablet Tb based on the imaged image. Here, the posture of the tablet Tb indicates a condition, such as the position, the direction, the inclination relative to the perpendicular direction, or upward side and the downward side of the tablet Tb on the carrying belt 21. Moreover, the condition of the damage (appearance defect) of the tablet Tb, such as a chipping, cracking, and dirt, is checked. The imaging region of the camera 40 includes a predetermined range between the tablet detection position Pd of the carrying belt 21 and the printing position Pp that is a downstream side where printing is performed. That is, the camera 40 is installed between the tablet detection position Pd and the printing position Pp which is where the printing is performed and is at the downstream side of the tablet detection position Pd. The imaging region may have any size as long as at least one entire tablet Tb is imaged. In order to suppress the data quantity of the imaged images while ensuring the imaging of one entire tablet Tb, the size may simultaneously cover two entire tablets Tb, but not cover the three entire tablets Tb. In order to achieve such an imaging region in accordance with various sizes of the tablet Tb, for example, the magnification of the lens of the camera 40 may be changed. This can be achieved by exchanging the lens with another lens that has the different magnification, or by applying a zoom lens. Moreover, the image processing may be performed on only the data of the above described imaging region in the picked-up image to achieve the above described imaging region. Alternatively, the region of the image captured by the camera 40 may be adjusted by, for example, using masks, etc. to achieve the above described imaging region.

[Printing Unit]

The printing unit 50 is a mechanism that performs printing on the tablet Tb being carried by the carrying device 20. The printing unit 50 performs, when the status of the sensor 30 is changed from the status not detecting the tablet Tb to the status detecting the tablet Tb, printing on the tablet Tb that has changed the status. That is, printing is performed on the tablet Tb that has changed the output signal of the sensor 30 from OFF to ON. In this embodiment, the tablet Tb that has changed the output signal of the sensor 30 from OFF to ON is imaged beforehand by the camera 40 as described above. Furthermore, the printing unit 50 performs printing on only the printable tablet Tb. That is, the tablet Tb that has changed the output signal of the sensor 30 from OFF to ON, imaged by the camera 40, and determined as printable is subjected to printing. When only the preceding tablet Tb is imaged because two or more tablets Tb are in contact with each other, the printing unit 50 performs printing only on the preceding tablet Tb, and does not perform printing on the following tablet Tb. Moreover, the printing unit 50 does not perform printing on the tablet Tb in a posture the printing is unabled (e.g., an inclined posture or a mispositioning that cannot be accepted). That is, when two or more tablets Tb are in contact with each other, the "printable" tablet Tb is the preceding tablet Tb that is in a printable posture and has an acceptable damage level.

The printing unit 50 includes a printing head 51, a printing checking camera 52, and a drying unit 53. The printing head 51 is an inkjet printer head that performs printing on the surface of the tablet Tb in accordance with printing data. The printing head 51 includes a plurality of nozzles that ejects ink droplets by driving energy generating elements, such as a piezo-electric element and a thermal element, to perform printing. The printing head 51 is installed at the printing position Pp at the downstream side of the camera 40 so as to face the surface of the carrying belt 21.

Meanwhile, the posture of the tablet Tb imaged by the camera 40 differs for each tablet Tb. Hence, even if the posture differs for each tablet Tb, the printing head 51 makes an adjustment to perform printing at a proper position based on the printing pattern in accordance with such differences.

The printing checking camera 52 is an imaging unit that images the tablet Tb having undergone printing. The printing checking camera 52 images each tablet Tb based on the trigger signal to be described later at the timing at which the entire tablet Tb enters the imaging region. The printing checking camera 52 images the tablet Tb after passing through the printing head 51, and checks a printing condition based on this imaged image. The imaging region of the printing checking camera 52 is set to be a predetermined region at the downstream side relative to the printing position Pp in the carrying direction D of the tablet Tb. That is, the printing checking camera 52 is installed at the downstream side of the printing position Pp.

The drying unit 53 is provided below the lower part of the carrying belt 21. The drying unit 53 is provided at the drive-pulley-22 side of the carrying belt 21, and dries and fixes inks of the character and the marking printed on the surface of the tablet Tb when the tablet Tb is carried by the carrying belt 21.

[Ejecting Device]

The ejecting device 60 is a device that ejects the tablet Tb from the carrying device 20. The ejecting device 60 includes two air blowing nozzles 61 and 62. The blowing sides of the air blowing nozzles 61 and 62 are respectively provided at the position facing collecting trays 71 and 72 to be described later across the carrying belt 21 within the sucking chamber 25. The air blowing nozzle 61 of the ejecting device 60 blows air to the tablet Tb which was not printed due to the improper posture and the tablet Tb which is other than the preceding tablet Tb among two or more tablets Tb in contact with each other among the tablet Tb which was not printed, when the tablets Tb comes to the corresponding to the collecting tray 71 to drop the tablets Tb to the collecting tray 71. Such tablet Tb which was not printed due to the improper posture and tablet Tb which is other than the preceding tablet Tb among two or more tablets Tb in contact with each other are collected in the collecting tray 71 as "re-use products". When the tablet Tb that is a defective product comes to the position corresponding to the collecting tray 72, the air blowing nozzle 62 blows air to drop the tablet Tb that is a defective product in the collecting tray 72. In this case, the tablet Tb that is a defective product includes the tablet Tb with appearance defect (damage level not acceptable), and the tablet Tb with printing defect.

[Collecting Device]

The collecting device 70 collects the tablets Tb that are defective products. The collecting device 70 includes the collecting trays 71 and 72. The collecting trays 71 and 72 are installed at the downstream side relative to the drying unit 53 in sequence, and are each a container with an opened upper part. These collecting trays 71 and 72 face the air blowing nozzles 61 and 62 across the carrying belt 21.

[Storing Device]

The storing device 80 stores the tablets Tb that are non-defective products. The storing device 80 is a tray that is installed at the downstream side relative to the collecting device 70 at the position where the sucking action by the sucking chamber 25 no longer acts, and has an opened upper part.

The tablets Tb are arranged in two rows by the aligning feeder 14 as described above. Moreover, the tablet Tb is supplied to the carrying belt 21 of the carrying device 20 via the transfer feeder 16. In this case, in order to perform printing on the each of the tablets Tb on the carrying belt 21 in two rows, in practice, the sensor 30, the camera 40, the printing head 51, the printing checking camera 52, the drying unit 53, the two air blowing nozzles 61 and 62, and the two collecting trays 71 and 72 are provided in two sets to be adopted to the tablets Tb in two rows. Since these two sets perform the same operation, the description will be given of either one set below.

[Control Device]

The control device 90 is a device that controls the operation of the tablet printing apparatus S. The control device 90 can be realized by a special-purpose electronic circuit or a computer that operates under a predetermined program, etc. The details of the operation of each component under the control of this control device 90 will be described later as an action of this embodiment.

Figure 3:
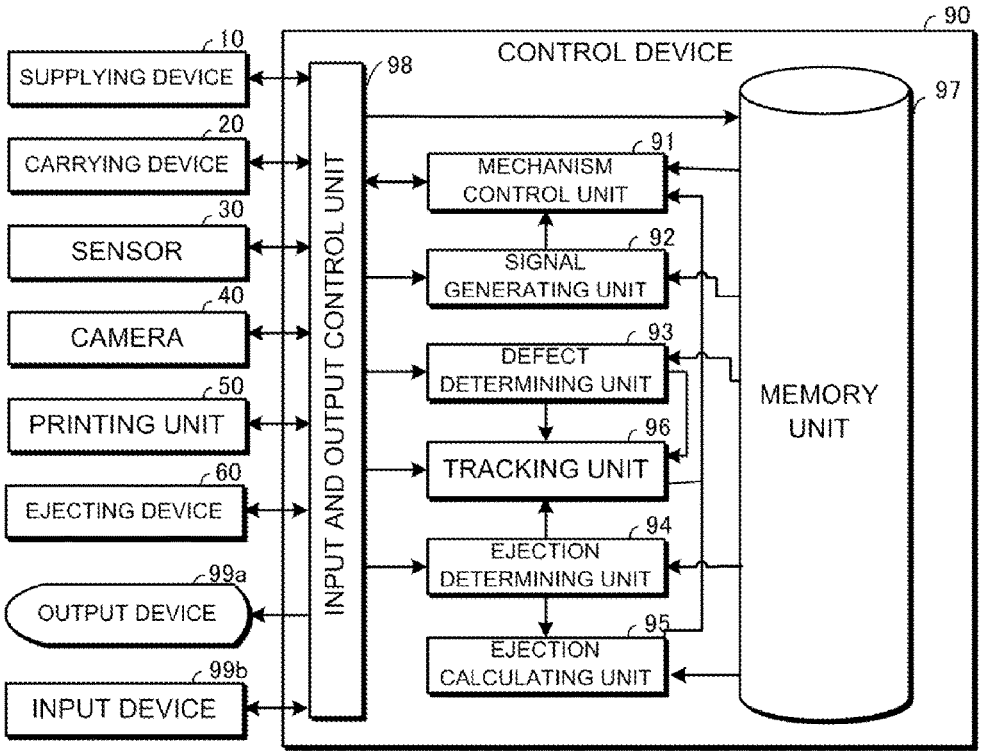
FIG. 3 is a block diagram illustrating a control device of the tablet printing apparatus according to the embodiment.

A structure of the control device 90 for realizing such a control will be described with reference to FIG. 3 that is a virtual functional block diagram. That is, the control device 90 includes a mechanism control unit 91, a signal generating unit 92, a defect determining unit 93, an ejection determining unit 94, an ejection calculating unit 95, a tracking unit 96, a memory unit 97, and an input and output control unit 98. The mechanism control unit 91 controls the supplying device 10, the carrying device 20, the drive source for the mechanism such as the printing unit 50, a valve, a switch, and a power supply, etc. That is, the mechanism control unit 91 controls the supplying device 10, the carrying speed of the carrying device 20, the imaging by the camera 40, the printing by the printing unit 50, and the ejection of the tablet Tb that is a defective product by the ejecting device 60.

The signal generating unit 92 generates the trigger signal based on the detection of the presence of the tablet Tb by the sensor 30. For example, the signal generating unit 92 generates the trigger signal when the signal of the output signal of the sensor 30 rises, that is, when output signal is changes from OFF to ON. As illustrated in FIG. 5, the trigger signal is a short-pulse signal. This trigger signal is generated in order to, for example, image the tablet Tb by the camera 40, and the imaging by the camera 40 is performed at a timing at which the center of the tablet Tb comes to the center of the imaging region of the camera 40 based on this trigger signal.

The camera 40 performs imaging based on the trigger signal. The imaging based on the trigger signal refers to, for example, performing imaging when a time length for the tablet Tb to move and to entirely enter in the imaging region has elapsed after the trigger signal is generated. For example, this may be a time length until the center of the tablet Tb comes to the center of the imaging region after the trigger signal is output.

The defect determining unit 93 determines the tablet Tb that is a defective product. For example, the defect determining unit 93 determines the tablet Tb with appearance defect such as dirt or damage such as chipping as a defective product based on the image data imaged by the camera 40. Moreover, for example, the defect determining unit 93 determines, the tablet Tb with printing defect on which printing is not properly performed as a defective product based on the image data imaged by the printing check camera 52. However, although the defect determining unit 93 identifies the tablet Tb not printable due to a posture defect on the carrying belt 21, since such a tablet may be reused, the defect determining unit does not determine as a defective product. The tablet Tb with appearance defect, and the tablet Tb not printable due to the posture defect are excluded from the printing objects of the printing unit 50.

Figure 5A:
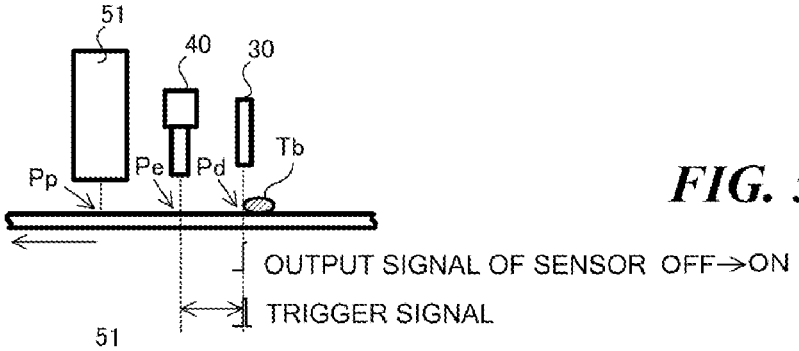
FIGS. 5(A) to 5(D) are each an explanatory diagram illustrating how the tablets carried with an interval therebetween is detected by a sensor, and imaged.
Figure 5B:
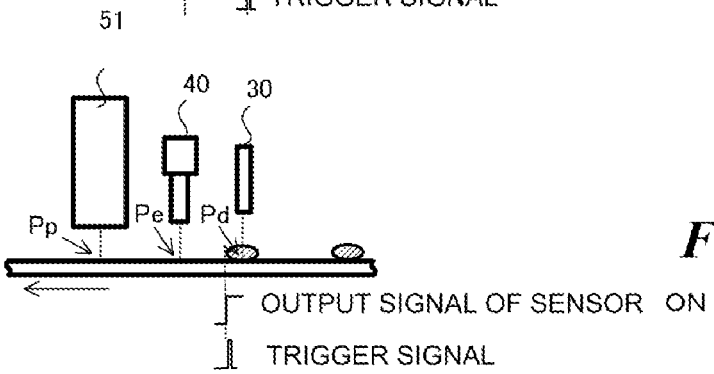
Figure 5C:
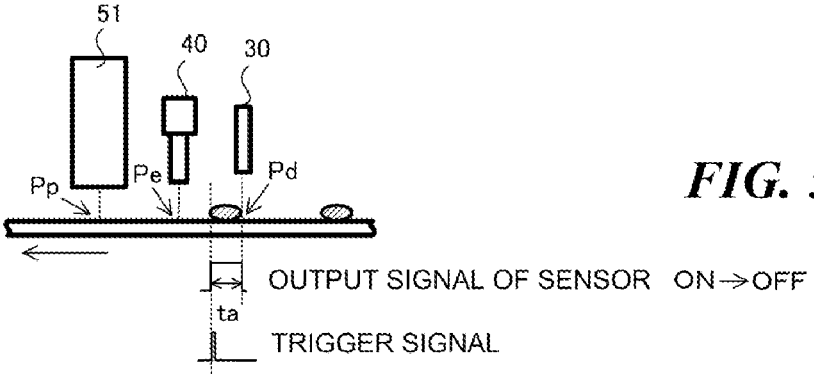

The ejection determining unit 94 determines, when the time length at which the sensor 30 is detecting the tablet Tb is longer than a predetermined setting value because two or more tablets Tb in contact with each other are carried, the following tablet Tb following the preceding tablet Tb as the tablet Tb to be ejected among two or more tablets Tb. The setting value may be obtained and defined based on the size of the tablet Tb. For example, as illustrated in FIG. 5(C), it is assumed a time length ta at which the length of one tablet Tb in the carrying direction passes through one point is the setting value. This time length ta may be obtained by dividing the length of one tablet Tb in the carrying direction by the carrying speed. If the tablet Tb is in a circular shape when viewed in the planar direction, the length of one tablet Tb in the carrying direction may be the diameter thereof. Moreover, the following tablet Tb following the preceding tablet Tb is the tablet Tb that continues at the downstream side relative to the preceding tablet Tb among the tablets Tb in contact with each other and in sequence.

However, the ejection determining unit 94 does not individually determine the following tablet Tb following the preceding tablet Tb, but determines from the end of the length of one preceding tablet Tb in the carrying direction until the sensor 30 no longer detects the tablet Tb as the position where the tablet Tb to be ejected is present. For example, the ejection determining unit 94 may determine the end of the preceding tablet Tb as a start position of the tablet Tb to be ejected.

The ejection calculating unit 95 obtains a reference value for the ejecting process by the ejecting device 60 based on the detection value of the sensor 30. In this embodiment, the reference value for the ejecting process is a time length to perform the ejecting process, and the ejection calculating unit 95 obtains the time length for the ejecting device 60 to perform the process of ejecting the tablet Tb based on the time length at which the sensor 30 had been detecting the tablet Tb. For example, FIG. 9(B) illustrates a time length t at which the sensor 30 had been detecting the tablet Tb. By subtracting the time length to that is the setting value at which one tablet Tb moves from the time length t at which the output signal of the sensor 30 has been maintained ON, the time length for ejecting the defective product may be obtained. The air blowing nozzle 61 of the ejecting device 60 keeps blowing air for the time length obtained by the ejection calculating unit 95 starting from the following tablet Tb following the preceding tablet Tb among two or more tablets Tb in contact with each other and carried. Hence, the following tablet Tb following the preceding tablet Tb is collected.

Moreover, the ejection calculating unit 95 may obtain the number of the tablets Tb to be ejected by the ejecting device 60 based on the time length at which the sensor 30 had been detecting the tablet Tb. For example, the number of the tablets Tb to be ejected may be obtained by subtracting the time length at which the output signal of the sensor 30 had been maintained ON by the setting value, and further dividing the subtracted value by the setting value. The setting value is obtained based on the size of the tablet Tb as described above. The air blowing nozzle 61 of the ejecting device 60 blows air by the number of times corresponding to the number determined by the ejection determining unit 94 starting from the following tablet Tb following the preceding tablet Tb among two or more tablets Tb in contact with each other and carried. Hence, the following tablet Tb following the preceding tablet Tb is collected.

The tracking unit 96 tracks the position of the tablet Tb on the carrying device 20. More specifically, the tracking unit 96 specifies where each moving tablet Tb is located based on the count value of the encoder pulses of the encoder 27. For example, the tracking unit 96 tracks, based on the output signal by the sensor 30 or the trigger signal, until the tablet Tb reaches the imaging region of the camera 40, and the printing position Pp and printing check positions of the printing checking camera 52 of the printing unit 50. Moreover, the tracking unit 96 tracks the position of the tablet Tb determined as a defective product by the defect determining unit 93 in the carrying device 20. Furthermore, the tracking unit 96 tracks the position of the tablet Tb determined to be ejected by the ejection determining unit 94. In this case, the positions tracked by the tracking unit 96 is the following position following the preceding tablet Tb and the position where the output signal of the sensor 30 becomes OFF. This indicates the position where the tablet Tb to be ejected is present.

The memory unit 97 stores various information necessary for the process by the tablet printing apparatus S. The stored information includes the setting value, the output signal of the sensor 30, time length at which this output signal maintains ON, the time length at which the tablet Tb is being ejected, the number of tablets Tb to be ejected, the reference such as the threshold to determine the tablet Tb that is a defective product, the image data imaged by the camera 40, the printing data indicating the details, such as a character and a marking to be printed, and the position of the tablet Tb being tracked.

The input and output control unit 98 is an interface that controls signal conversion and input and output between each component to be controlled.

Output devices 99*a*, such as a display, a lamp, and a gauge, for checking the device status are connected to the control device 90. The output signal of the sensor 30, the trigger signal, the image data imaged by the camera 40, etc., may be displayed on the output devices 99*a*. Moreover, input devices 99*b*, such as a switch, a touch panel, a keyboard, and a mouse, for an operator to input information required for the operation of the tablet printing apparatus S are connected to the control device 90.

[Operation]

In the tablet printing apparatus S of this embodiment, the procedure of printing a character and a mark on the surface of the tablet Tb will be described with reference to the figure. When the status of the sensor 30 that detects the tablet Tb being carried by the carrying device 20 is changed the status from the status not detecting the tablet Tb to the status detecting the tablet Tb, the tablet printing apparatus S causes the printing unit 50 to perform printing on the tablet Tb that changed the status. When, however, the detection value of the sensor 30 after the status changed exceeds the predetermined setting value, the tablet Tb that changed the status, and the tablet Tb at a part corresponding to the detection value detected as exceeding the predetermined setting value are distinguished and collected. In below, such procedures are described in detail. In the following operation, it should be noted that as the tablet Tb to be ejected as not being a non-defective product, there is the tablet Tb with appearance defect that has problem on the appearance, such as chipping, cracking, foreign material, and dirt. Such a tablet is determined as a defective product. Moreover, there is the tablet Tb with printing defect that has insufficient printing. This is also determined as a defective product. Still further, there is also the tablet Tb on which printing, etc. has not been performed due to posture defect. This is not determined as the defective product, but is ejected. The following tablet Tb following the preceding tablet Tb when two or more tablets Tb in contact with each other is not determined as the defective product, but is ejected.

[Printing Procedure when Tablets are Carried with Intervals]

Figure 4:
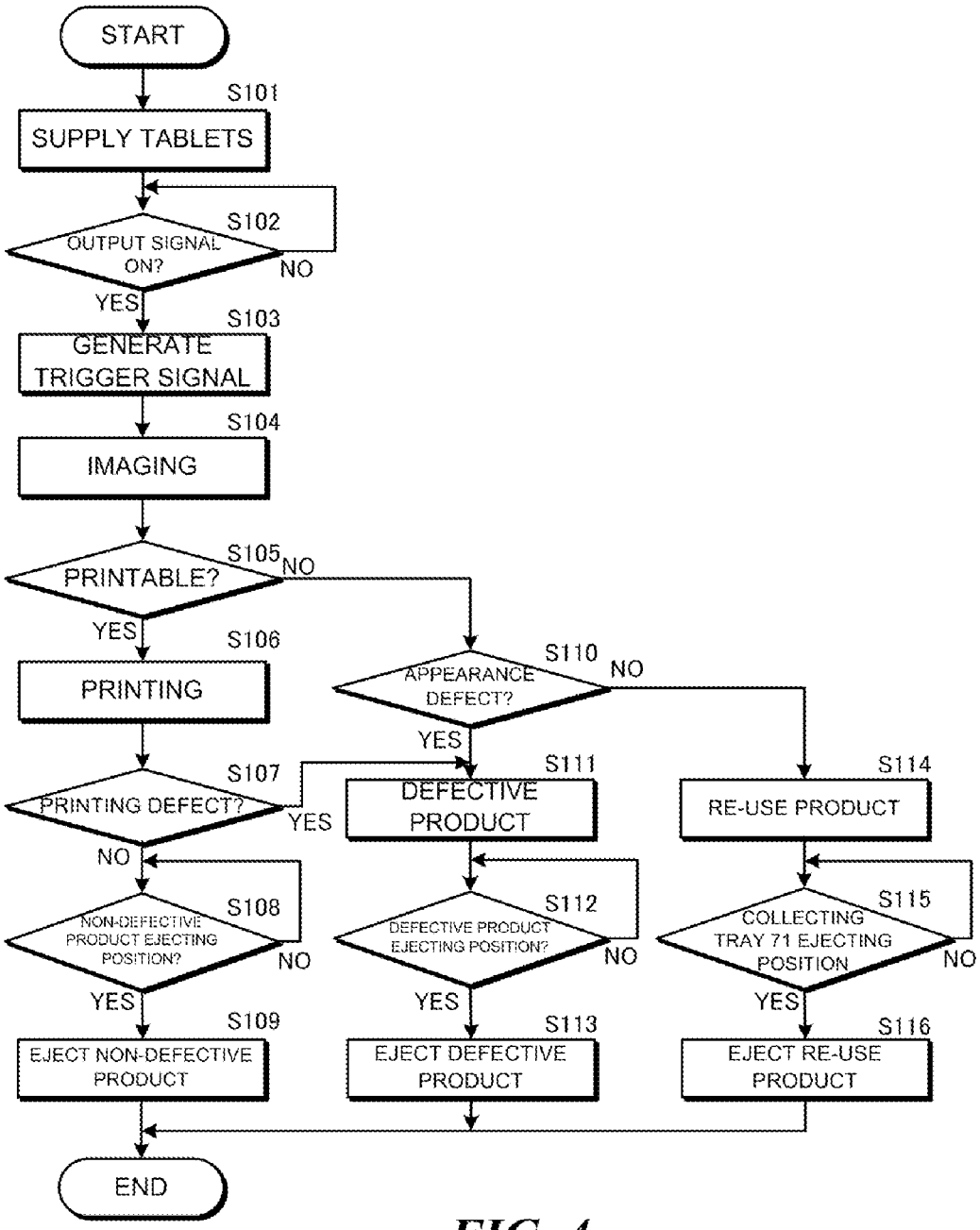
FIG. 4 is a flowchart illustrating a tablet-that-is-non-defective-product printing procedure.

A printing procedure when the individual tablets Tb are carried with an interval therebetween will be described with reference to the flowchart that is FIG. 4, and the explanatory diagrams that are FIG. 5 and FIG. 6. First, the supplying device 10 supplies the tablets Tb to the carrying device 20 (step S101). That is, the tablets Tb stored in the hopper 11 are fed to the aligning feeder 14 via the vibration feeder 12. The aligning feeder 14 aligns, for example, the tablets Tb in two rows, and feeds the tablets Tb aligned in two rows to the transfer feeder 16. The transfer feeder 16 feeds the tablets Tb to the carrying device 20. As illustrated in FIG. 2, the carrying device 20 carries the tablets Tb in a condition sucked and held by the carrying belt 21 in two rows.

The sensor 30 waits for the tablet Tb in each row carried by the carrying device 20 to come to the tablet detection position Pd (step S102: NO). When the tablet Tb comes to the tablet detection position Pd, as illustrated in FIG. 5(A), the sensor 30 detects the presence of the tablet Tb and causes the output signal to be ON (step S102: YES). At this time, the signal generating unit 92 generates the trigger signal (step S103). Note that, as indicated by "sensor output signal" in FIG. 5(C), the output signal of the sensor 30 becomes OFF when the tablet Tb passes through the tablet detection position Pd and the sensor 30 no longer detects the presence of the tablet Tb. That is, as for the sensor 30, when the tablet Tb is present on the surface of the carrying belt 21, the output signal is ON, and when the tablet Tb is not present, the output signal is OFF. Note that the flowchart that is FIG. 4 does not indicate that the process of step S104 and process subsequent to the step S104 are executed after the trigger signals for all the tablets Tb are generated in the step S103. Simultaneously with the generation of the trigger signal for each tablet Tb, the processes, such as imaging and printing, are performed on the preceding tablet Tb.

Figure 5D:
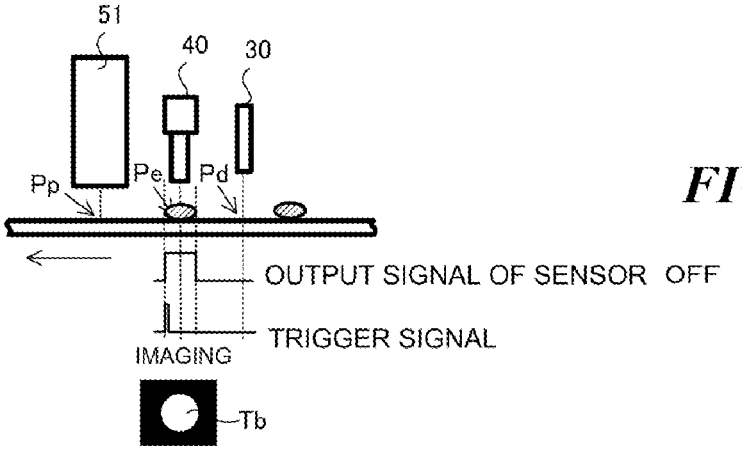
Figure 6A:
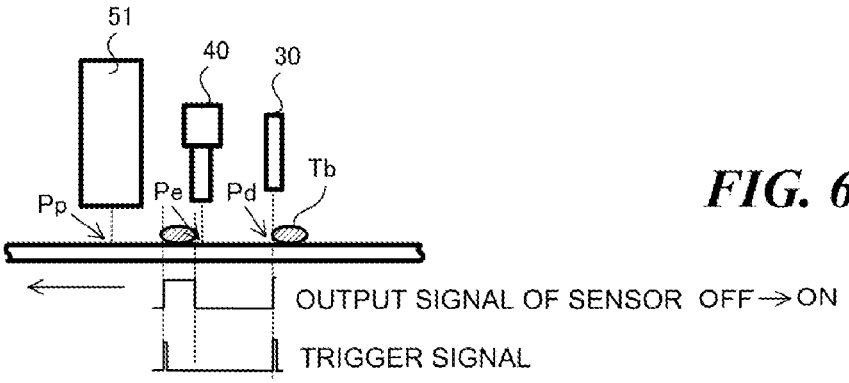
FIGS. 6(A) to (D) are each an explanatory diagram illustrating how printing is performed on the tablet after being imaged.
Figure 6B:
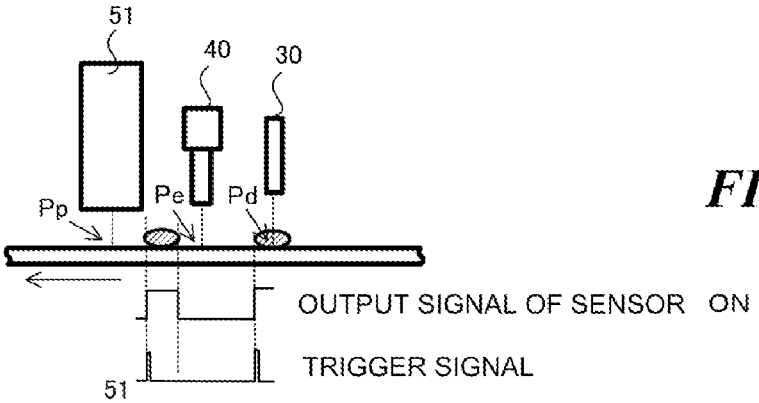
Figure 6C:
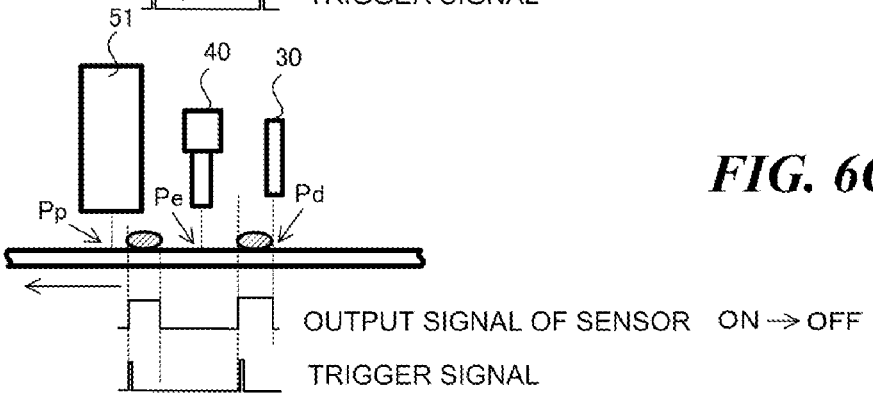

The camera 40 images the image at the timing with reference to the trigger signal as illustrated in FIG. 5(D) (step S104). When this imaging timing is set to be a timing at which the tablet Tb that has changed the output signal of the sensor 30 from ON to OFF moves, and entirely enters the imaging region, as illustrated in FIG. 5(D), the camera 40 can image the entire tablet Tb. In addition, as illustrated in FIGS. 6(A) to 6(C), as described above, the detection by the sensor 30 and the generation of the trigger signal are performed for the following tablet Tb.

The defect determining unit 93 determines whether the tablet Tb is printable or not based on the imaged image data (step S105). The determination by the defect determining unit 93 is performed by detecting damages (appearance defect), such as dirt of the tablet Tb and chipping thereof, and the posture of the tablet Tb from the imaged image data, and making determination based on whether the damage and posture in a level printable or not. The posture includes the up or back surface of the tablet Tb, the position on the carrying belt 21, the direction held and the inclination relative to the vertical direction on the carrying belt 21, etc. The tablet Tb that is not printable because of the posture defect and not the appearance defect has a possibility of re-use, and therefore the defect determining unit 93 does not determine this tablet as a defective product, collects this tablet in the collecting tray 71 as a re-use product.

Figure 6D:
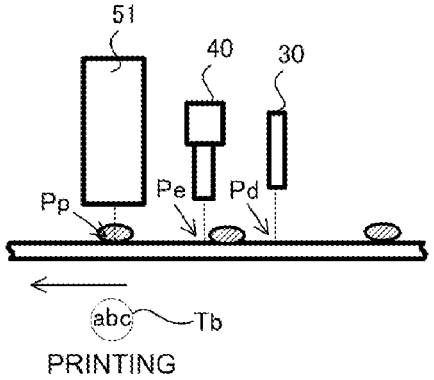
Figure 7:
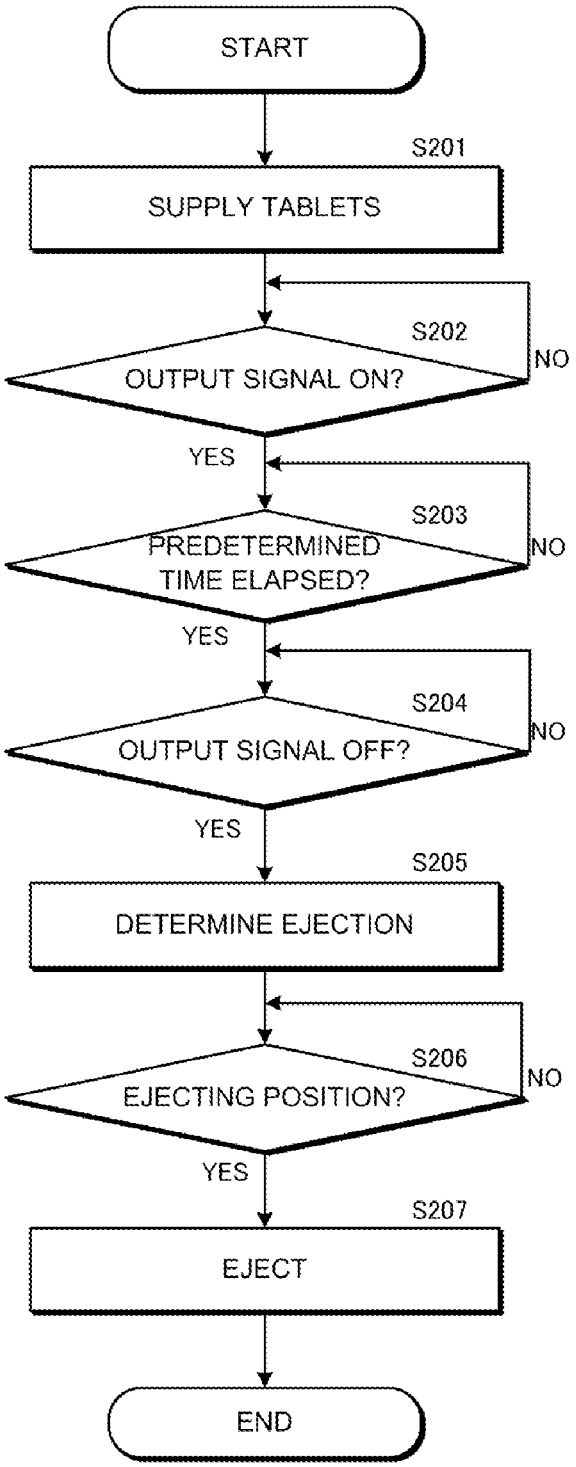
FIG. 7 is a flowchart illustrating a procedure of ejecting following tablets following a preceding tablet among a plurality of the tablets that are carried and in contact with each other.
Figure 8A:
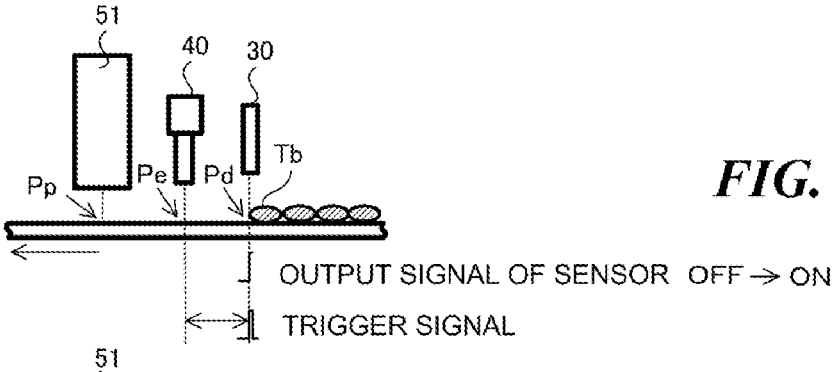
FIGS. 8(A) to 8(D) are each an explanatory diagram illustrating how the preceding tablet among the plurality of the tablets that are carried and in contact with each other is detected by the sensor and imaged.
Figure 8B:
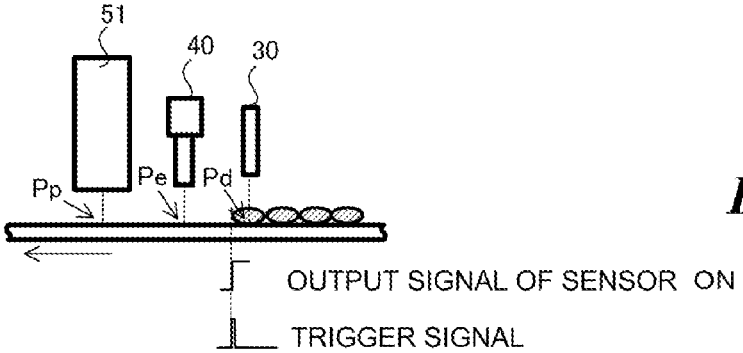
Figure 8C:
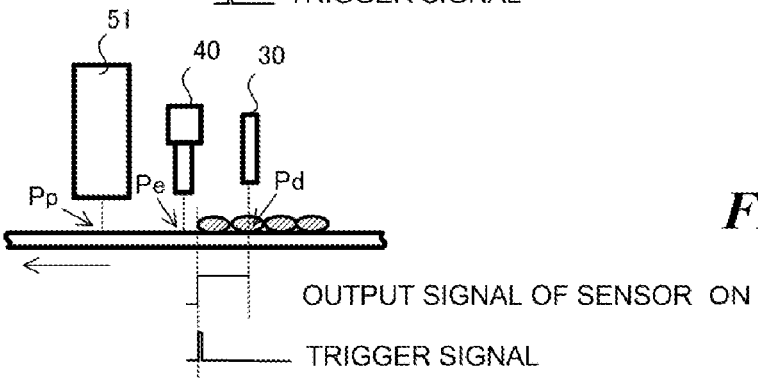
Figure 8D:
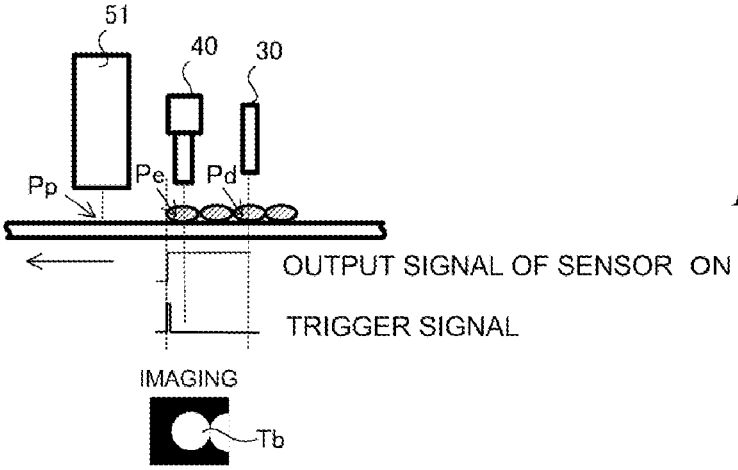

When it is determined printable (step S105: YES), the printing head 51 performs printing on the tablet Tb that passes through the printing position Pp as illustrated in FIG. 6(D) (step S106). In order to perform this printing, the eject pattern of the ink droplets from the plurality of the nozzles of the printing head 51 is created based on the printing data of the character, and the marking, etc., to be printed, and the information of the damage and posture of the tablet Tb. When the printing head 51 ejects ink droplets based on this eject pattern, the character, and the marking, etc. are printed in predetermined direction at the predetermined position of the surface of the tablet Tb.

When it is determined not printable (step S105: NO), the printing head 51 does not perform printing on the tablet Tb that passes through the printing position Pp. That is, the data of not printing is to be created. It is determined whether the tablet Tb, that is determined as not printable and that is not printed, is not printed because of the appearance defect or not (step S110), and when this is because of the appearance defect (step S110: YES), the tablet is a defective product (step S111). Therefore, the tablet Tb that is determined as not printable because of the posture defect, not the appearance defect (step S110: No) is determined as the re-use product as described above (step S114). Subsequently, the tracking unit 96 tracks the position of the tablet Tb not printed based on the value of the encoder 27.

Furthermore, when the tablet Tb printed at the printing position Pp enters the imaging region of the printing checking camera 52, the printing checking camera 52 images an image in the predetermined imaging region. The defect determining unit 93 determines whether the character and the marking are printed properly on the tablet Tb or not based on the imaged image data (step S107). The tablet Tb that is determined as not printed properly (step S107: YES) is determined as a defective product (step S111), and consequently the tracking unit 96 tracks the position thereof based on the value of the encoder 27. The tablet Tb determined as printed properly (step S107: NO) is not determined as a defective product, and is carried.

The tablet Tb that has passed through the imaging region of the printing checking camera 52 is further carried along with the movement of the carrying belt 21, and the inks of the character and the marking printed on the surface are dried and fixed while being carried facing the drying unit 53. Moreover, the tablet Tb goes to the defective product ejecting position corresponding to the collecting trays 71 and 72 (step S112: NO).

When the tablet Tb that is not printed because of the posture defect and having the position tracked by the tracking unit 96 comes to the ejecting position corresponding to the collecting tray 71 (step S115: YES), the air blowing nozzle 61 blows air. This causes the tablet Tb to be blown from the carrying belt 21, drops in the collecting tray 71, thus being ejected and collected as a re-use product (step S116).

In contrast, when the tablet Tb to which printing is not performed properly because of the damage, such as dirt or chipping, that is the appearance defect and printing defect and which has the position tracked by the tracking unit 96 for being determined as a defective product comes to the defective product ejecting position corresponding to the collecting tray 72 (step S112: YES), the air blowing nozzle 62 blows air. Hence, the tablet Tb is blown from the carrying belt 21, drops in the collecting tray 72, thus being collected (step S113).

The tablet Tb that is the non-defective product to which printing is performed properly (step S107: NO) keeps moving toward the non-defective product ejecting position at the carrying end (step S108: NO). Next, when the tablet arrives the non-defective product ejecting position (step S108: YES), the sucking action by the sucking chamber 25 is no longer active, and the tablet Tb drops in the storing device 80 and is collected. That is, this tablet is ejected as a non-defective product (step S109).

[Process Procedure when Tablets in Contact with Each Other are Carried]

As described above, the tablets Tb that are supplied from the supplying device 10 to the carrying device 20 are usually carried with an interval therebetween. However, the tablet Tb may be carried in contact with the following tablet Tb. In this case, the output signal of the sensor 30 that has detected the preceding tablet Tb is maintained ON once becoming ON from OFF unless the condition in which the tablets Tb are in contact with each other is canceled and the interval is provided.

Moreover, when the output signal of the sensor 30 changes from OFF to ON and a signal level rise occurs, the signal generating unit 92 generates the trigger signal along with the rise of the signal level. The camera 40 images the tablet Tb when this trigger signal is generated. Hence, as long as the ON state is maintained, the signal generating unit 92 does not generate the trigger signal. Accordingly, as long as the ON state is maintained, the camera 40 does not image the following tablet Tb in contact with the preceding tablet Tb. Moreover, those tablets Tb are then not subjected to printing, printing checking, defect determination, and defect ejection.

A process procedure when two or more tablets Tb in contact with each other are carried will be described with reference to the flowcharts that are FIG. 4 and FIG. 7, and FIGS. 8 to 10 that are explanatory diagrams. First, even if two or more tablets Tb in contact with each other are carried, as for the preceding tablet Tb, like the above case in which the tablets Tb are carried with an interval therebetween, printing is performed through the procedure as illustrated in the flowchart that is FIG. 4.

That is, as illustrated in FIGS. 8(A) to 8(D), the camera 40 images the preceding tablet Tb at the timing based on the trigger signal generated upon the rise of the signal level of the output signal of the sensor 30 from OFF to ON. Moreover, when the preceding tablet Tb is printable, as illustrated in FIG. 9(C), printing is performed. When the printing is performed properly on the preceding tablet Tb, this tablet is collected in the storing device 80 as a non-defective product. When the preceding tablet Tb is a defective product or a re-use product, such a tablet is collected in the collecting device 70.

Figure 9A:
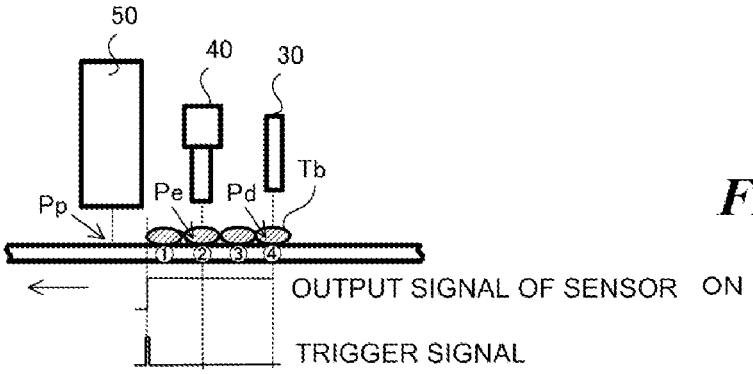
FIGS. 9(A) to 9(D) are each an explanatory diagram illustrating how printing is performed on the preceding tablet among the plurality of the tablets that are carried and in contact with each other after being imaged.
Figure 9B:
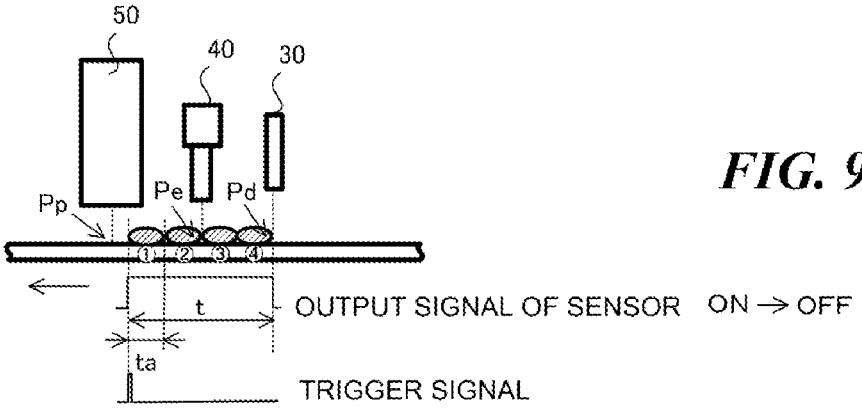
Figure 9C:
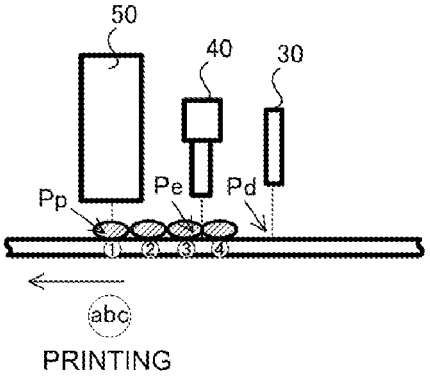

As for the following tablet Tb following the preceding tablet Tb, the tablet is supplied to the carrying device 20 (step S201), and as illustrated in FIG. 9(A), after the preceding tablet Tb changes the output signal of the sensor 30 to ON (step S202), a predetermined time elapses (step S203: YES), and the ejection determining unit 94 waits until this output signal changes to OFF (step S204: NO). As illustrated in FIG. 9(B), when the output signal of the sensor 30 becomes OFF (step S204: YES), the ejection determining unit 94 determines the tablet Tb to be ejected (step S205). That is, the following position following the preceding tablet Tb is determined as the position of the tablet Tb to be ejected.

When the tablet Tb is in contact with the following tablet Tb, as illustrated in FIGS. 8(C), 8(D), and FIGS. 9(A), 9(B), the output signal of the sensor 30 is ON during a time length t that is longer than the moving time length ta for one tablet Tb. Hence, the setting value is set to be the time length ta for movement of the length of one tablet Tb in the carrying direction, and when the output signal of the sensor 30 does not become OFF even when exceeding this time length, the ejection determining unit 94 determines that the tablet Tb is being carried while in contact with the following tablet. Next, the ejection determining unit 94 determines that the following tablet Tb following the preceding tablet Tb should be ejected.

Figure 9D:
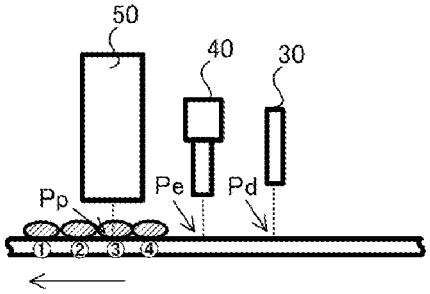

At this time, as illustrated in FIG. 9(B), the ejection calculating unit 95 obtains the time length for ejecting the defective product and the re-use product based on the time length t at which the output signal of the sensor 30 is maintained ON. The ejection determining unit 94 may obtain the number of defective products and re-use products to be ejected as described above. As illustrated in FIG. 9(D), the printing unit 50 does not perform printing on the tablet Tb determined as to be ejected.

The tablet Tb goes to the ejecting position corresponding to the collecting tray 71 (step S206: NO). Thereafter, based on the value of the encoder 27, the tracking unit 96 tracks the position of the tablet Tb determined as to be ejected. As for the following tablet Tb in contact with the preceding tablet Tb, printing, printing checking, etc., are not performed, but the position thereof is tracked by the tracking unit 96. In FIG. 9 and FIG. 10, the preceding tablet Tb is indicated by a circled number 1, while the following tablets Tb thereto are indicated by circled numbers 2 to 4.

Figure 10A:
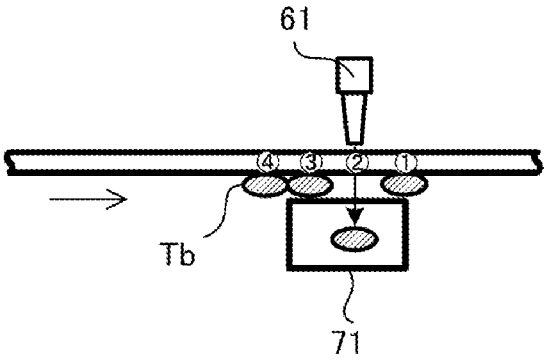
FIGS. 10(A) to 10(C) are each an explanatory diagram illustrating how the following tablets following the preceding tablet among the plurality of the tablets that are carried and in contact with each other is ejected.
Figure 10B:
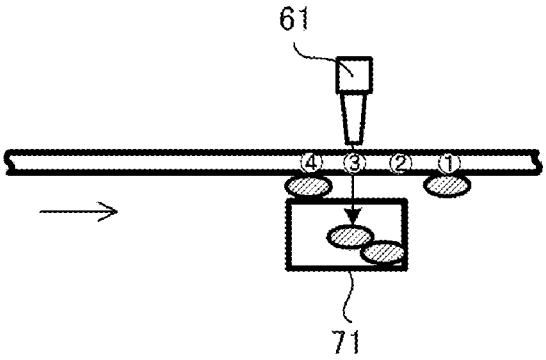
Figure 10C:
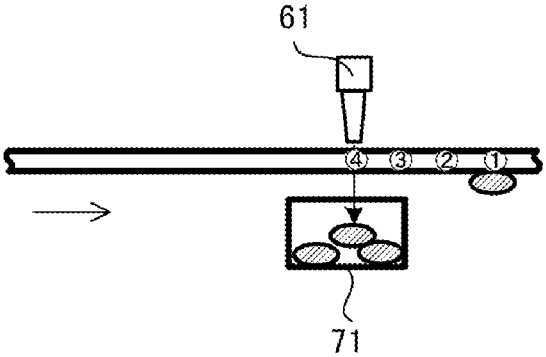

As illustrated in FIG. 10(A), when this tablet Tb comes to the ejecting position corresponding to the collecting tray 71 (step S206: YES), the air blowing nozzle 61 starts blowing air. The tablet Tb indicated by the number 2 is blown from the carrying belt 21, drops in the collecting tray 71, thus being collected as a re-use product. The air blowing nozzle 61 also causes the tablets Tb indicated by the numbers 3 and 4 to drop in the collecting tray 71 by blowing air by the time length for ejection that is calculated by the ejection calculating unit 95 as illustrated in FIGS. 10 (B) and 10(C). Accordingly, the following tablets Tb following the preceding tablet Tb are collected (step S207).

[Action and Effect]

The tablet printing apparatus S according to this embodiment as described above includes the carrying device 20 that carries the tablets Tb, the sensor 30 that detects the tablet Tb being carried by the carrying device 20, the printing unit 50 that performs, when the status changes from the status in which the sensor 30 is not detecting the tablet Tb to the status in which the tablet Tb is detected, printing on the tablet Tb that has changed the status, and the collecting unit R that distinguishes and collects, when the time length at which the sensor 30 is detecting the tablet Tb is longer than the setting value because two or more tablets Tb in contact with each other are carried, the preceding tablet Tb and the following tablet Tb thereto among two or more tablets Tb.

In this case, when the presence and absence of the tablet Tb is detected based on the ON and OFF of the output signal of the sensor 30, and the trigger signal is generated based on the rise of the signal level of the output signal of the sensor 30 from OFF to ON for the subsequent imaging by the camera 40 and the printing process by the printing unit 50, etc., if two or more tablets Tb that are in contact with each other are carried, the rise of the signal level of the output signal of the sensor 30 from OFF to ON occurs only at the preceding tablet Tb. Hence, since a trigger signal is not generated at the following tablet Tb, the supply of such a tablet Tb to the carrying device 20 itself is not recognized by the tablet printing apparatus S. Accordingly, as for such a tablet Tb, processes such as printing, etc. are not performed at all. Moreover, such an unprocessed tablet Tb is not ejected. Consequently, such a tablet is collected in the storing device 80 for non-defective products, and is mixed with the non-defective products. Such a mixing requires a sorting work of the tablet Tb not processed from the non-defective products among the tablets Tb collected in the storing device 80, decreasing the productivity.

In this embodiment, when two or more tablets Tb that are in contact with each other are carried, and when the output signal of the sensor changes from OFF to ON, the printed preceding tablet Tb and the following tablet Tb thereto can be distinguished and collected. Hence, it is not required to sort the tablet Tb that is the non-defective product from the unprocessed tablet Tb, preventing the reduction of the productivity. Moreover, the tablet Tb that is following the preceding tablet Tb and not subjected to the printing process is easily re-used by being collected for re-use, etc., a waste can be prevented, suppressing the reduction of the productivity.

Furthermore, according to this embodiment, the tablet printing apparatus S includes the ejection determining unit 94 that determines, as the tablet Tb to be ejected, the following tablet Tb following the preceding tablet Tb, and the collecting unit R includes the ejecting device 60 that ejects the tablet Tb determined by the ejection determining unit 94 as the tablet to be ejected. Hence, the following tablet Tb following the preceding tablet Tb can be distinguished from the preceding tablet Tb, and removed from the carrying device 20.

According to this embodiment, the tablet printing apparatus S includes the ejection calculating unit 95 that calculates the time length for the process of ejecting the tablet Tb by the ejecting device 60 based on the time length at which the sensor 30 is detecting tablet Tb.

The time length at which the sensor 30 is detecting the tablet Tb corresponds to the distance in which the carried tablets Tb in contact with each other are present, the tablet Tb not printed can be surely ejected based on this time length.

Moreover, the ejection calculating unit 95 may obtain the number of the tablets Tb to be ejected by the ejecting device 60 based on the time length at which the sensor 30 is detecting the tablets Tb. This enables the ejecting device 60 to recognize the number of the following tablets Tb following the preceding tablet Tb and to be ejected, enabling an individual ejecting process. As for such an ejecting process, for example, air is intermittently blown from the air blowing nozzle of the ejecting device 60 at an interval in accordance with the number of times corresponding to the recognized number, and the size of the tablet Tb. Since air is blown intermittently, the air consumption amount can be reduced in comparison with a case in which air is continuously blown for a predetermined time. This enables the tablet printing apparatus S to achieve the energy saving for supplying high-pressure air when the high-pressure air is provided externally. Moreover, when the high-pressure air is produced by a compressor, etc., in the tablet printing apparatus S, the activation time of the compressor can be reduced, achieving the energy saving.

Moreover, according to this embodiment, the tablet printing apparatus S includes the imaging unit that images the tablet Tb being carried by the carrying device 20 at least either before or after the printing by the printing unit 50, and the defect determining unit 93 that determines whether the tablet Tb is printable or not based on the image data imaged by the imaging unit. The imaging unit may be the camera 40 or the printing checking camera 52, etc. Furthermore, the collecting unit R includes the collecting device 70 that distinguishes and collects the tablet Tb determined by the ejection determining unit 94 as to be ejected, the non-defective product, the tablet Tb determined by the defect determining unit 93 as not printable and as the defective product, and the tablet Tb determined as non-printable but re-usable.

Hence, when two or more tablets Tb in contact with each other are carried, the following tablet Tb following the preceding tablet can be distinguished and collected as the re-use product from the defective product and the non-defective product. Therefore, in order to re-supply the following tablet Tb following the preceding tablet, an additional sorting work is not required, improving the productivity.

Other Embodiments

The present disclosure is not limited to the above embodiment.

(1) A structure in which no camera 40 is installed is applicable. That is, in the above embodiment, the camera 40 images the tablet Tb that has changed the output signal of the sensor 30 from OFF to ON, and the process such as printing is performed based on the imaged image. However, the camera 40 may be omitted, and printing by the printing unit 50, imaging by the printing checking camera 52, and ejection by the ejecting device 60 may be performed on the tablet Tb that has changed the status of the sensor 30 from the status of not detecting the tablet Tb to the status of detecting the tablet Tb. In this case, even if two or more tablets Tb in contact with each other are carried, the similar process can be applied.

Moreover, as a result of imaging by the camera 40 based on the trigger signal, when the center position of the tablet Tb is misaligned with the center of the imaging region of the camera 40, the printing timing of the printing unit 50 may be corrected based on this misalignment. Moreover, the imaging timing of the printing checking camera 52, and the ejecting timing of the ejecting device 60 can be corrected likewise. For example, in the image imaged by the camera 40, when the center position of the tablet Tb is located at the upstream side relative to the center of the imaging region of the camera 40, the printing timing of the printing unit 50 is delayed. In contrast, when the center position of the tablet Tb is located at the downstream side relative to the center of the imaging region of the camera 40, the printing timing of the printing unit 50 is advanced. When the position of the preceding tablet Tb is misaligned, the ejecting timing of the following tablet Tb following the preceding tablet is also deviated. In such a case, correcting the ejecting timing of the ejecting device 60 is especially effective.

By correcting the timing based on the imaging result of the camera 40, printing by the printing unit 50, imaging by the printing checking camera 52, and ejection by the ejecting device 60 are performed at proper timings, preventing a printing defect and a collection defect.

Moreover, the rise of the signal level of the output signal of the sensor 30 may be directly taken as the trigger signal, and the trigger signal may not be generated individually.

(2) In the above embodiment, the setting value for distinguishing the following tablet Tb following the preceding tablet among two or more tablets Tb in contact with each other and carried is the time length at which the length of one tablet Tb in the carrying direction moves. Moreover, in order to calculate the ejection length and the number of the tablets to be ejected, the time length for one tablet is adopted. However, it is unnecessary to precisely set this setting value to be the time length for one tablet Tb.

Figure 11A:
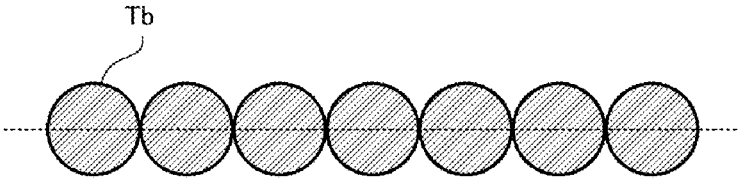
FIGS. 11(A) to 11(D) are each a diagram illustrating the plurality of the tablets that are carried and in contact with each other as viewed in a planar direction.
Figure 11B:
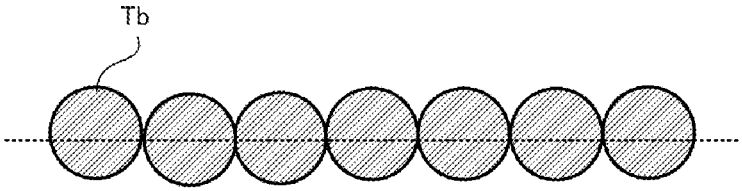
Figure 11C:
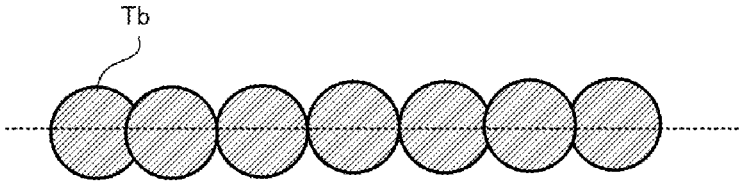
Figure 11D:
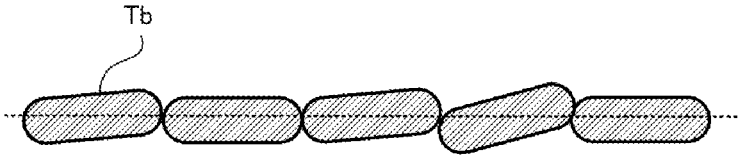

As illustrated in FIG. 11(A), when an ideal condition in which the center of the tablets Tb is arranged to pass through the tablet detection position Pd of the sensor 30 is assumed, the setting value may be the time length for precisely one tablet. As illustrated in FIG. 11(B), however, the center of the tablet Tb may be misaligned with the tablet detection position Pd of the sensor 30, or as illustrated in FIG. 11(C), the tablets Tb may overlap with each other. Moreover, as illustrated in FIG. 11(D), in the case of the tablet Tb that is not a circle when viewed in the planar direction, it is difficult to precisely specify the time length for one tablet. In addition, the tablet Tb has a variability in size. Hence, the time length to be set for one tablet may be a value with a margin relative to the precise time length for one tablet, or may be extended or shortened within an allowable range.

For example, the time length to be set for one tablet may be a passing time that is equal to or more than one precise tablet but less than two tablets. In order to accurately distinguish the preceding tablet Tb from the following tablet, the upper limit may be substantially 1.8 times as much as the passing time for one precise tablet, but more preferably, 1.5 times. Moreover, the average of the passing times for one tablet Tb may be obtained, and such an average may be set as the setting value. The average of the passing times for one tablet Tb may be obtained during the operation of the tablet printing apparatus S, and the setting value may be changed as appropriate to this average value.

Figure 12A:
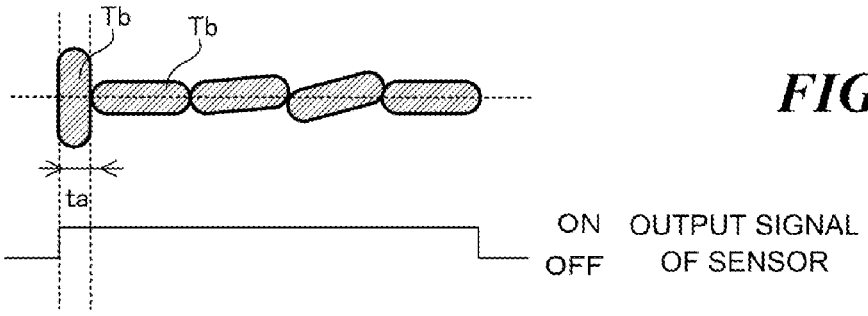
FIGS. 12(A) to 12 (D) are each a diagram illustrating the plurality of the tablets that are carried in different directions.
Figure 12B:
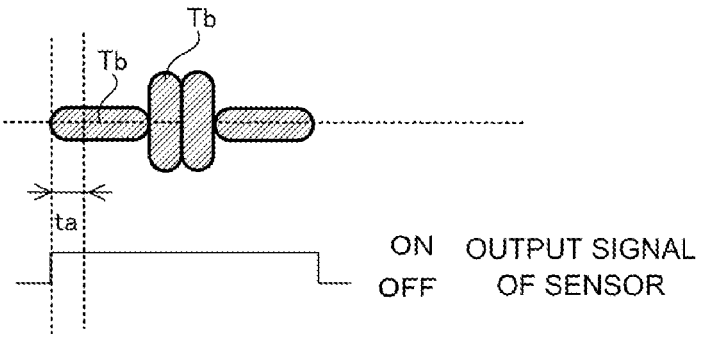
Figure 12C:
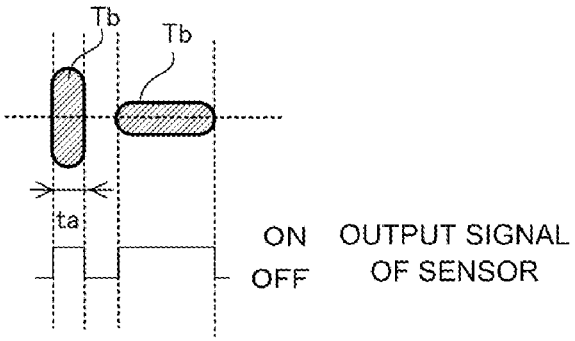

Furthermore, the control device 90 may include a setting value determining unit that determines the setting value based on the image data imaged by the imaging unit that images the tablet Tb being carried by the carrying device 20. In the case of, for example, the tablet Tb in a shape that has a short diameter and a long diameter, when the time length ta that is the setting value is set as the passing time of the short diameter of one tablet Tb, as illustrated in FIG. 12(A), if the preceding tablet Tb has the short-diameter along the carrying direction and the following tablet Tb has the long-diameter along the carrying direction, the following tablet Tb is ejected as the tablet Tb to be ejected. However, as illustrated in FIG. 12(B), when the preceding tablet Tb that has the long-diameter aligned along the carrying direction comes, the timing for determining whether to eject or not comes at the halfway location of the preceding tablet Tb, and there is a possibility that the preceding tablet Tb also becomes a target to be ejected. Moreover, when the tablets Tb are carried with an interval therebetween, and when the time length ta that is the setting value is set as the passing time of the short diameter of one tablet Tb, as illustrated in FIG. 12(C), there is no problem when the tablet Tb is carried with the short-diameter aligned along the carrying direction. However, as illustrated in FIG. 12(D), when the tablet Tb is carried with the long-diameter aligned along the carrying direction, it may be determined that two or more tablets Tb in contact with each other are carried, and this tablet Tb becomes a target to be ejected.

Meanwhile, when the sensor 30 detects the tablet Tb on the carrying belt 21, based on the rise of the signal level of the output signal of the sensor 30, and the trigger signal generated based on this rise of signal level, the camera 40 images this tablet Tb. Accordingly, it is determined in which direction the tablet Tb is carried based on the image data imaged up by the camera 40, and it is determined whether the presently applied setting value is appropriate or not based on the actual length of one tablet Tb. Next, the carrying time length is obtained based on the length of one tablet Tb, and when the setting value that is the time length Ta is replaced with the obtained time length, the possibility that the tablet Tb that should not be ejected is ejected can be reduced.

Moreover, when the tablet Tb in a shape that has the short diameter and the long diameter as illustrated in FIG. 12 is to be processed, the above problems can be addressed by always setting the time length ta that is the setting value as the passing time of the long diameter of one tablet Tb. Even in a case as illustrated in FIG. 12(A) and in a case as illustrated in FIG. 12(B), when the time length ta is the passing time of the long diameter of one tablet Tb, the tablet may be ejected at the time length corresponding to the time at which the sensor 30 is rising after the time length ta has elapsed and at the position corresponding the collecting tray 71. This enables all of the following tablets Tb after the time length ta has elapsed to be blown by air even if the tablets Tb are carried as illustrated in FIG. 12(A), and only the tablet Tb not printed can be collected in the collecting tray 71.

Figure 12D:
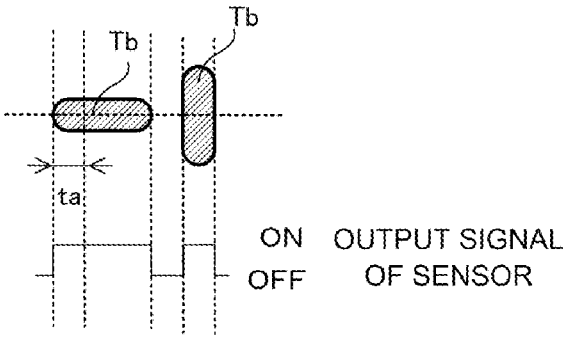

Moreover, even when the tablets Tb are carried with an interval therebetween as illustrated in FIG. 12(C) and FIG. 12(D), the problems can be addressed by setting the time length ta that is the setting value as the passing time of the long diameter of one tablet Tb When the tablets Tb are carried as illustrated in FIG. 12(D), since the output signal of the sensor 30 becomes OFF after the time length ta has elapsed, it can be checked that two or more tablets Tb not in contact with each other are carried, and thus the subsequent processes can be performed normally. In contrast, when the tablets Tb are carried as illustrated in FIG. 12(C), the output signal of the sensor 30 becomes OFF before the time length ta elapses, and becomes ON again. When the output signal of the sensor 30 becomes ON again before the time length ta elapses as described above, by resetting the elapsed time of the time length ta, the printing process can be performed appropriately when the tablets Tb are carried as illustrated in FIG. 12(C)

(3) In the embodiment, the "time length" is taken as an example of the detection value of the detecting unit. However, the "detection value" is not limited to this example, and broadly covers a value indicating a continuous quantity upon the detection of the tablet Tb by the detecting unit. The detection value includes a clock number of the CPU of a computer, an encoder pulse number of the encoder, a clock number thereof, the "time length" and "distance" calculated by the CPU based on the pulse number. Hence, for example, a control may be performed based on the "distance" instead of the "time length" or a control may be performed based on the encoder pulse number. "Upon the detection of the tablet Tb" covers the case in which the sensor 30 changes from OFF to ON, and the case in which the sensor changes from ON to OFF. As for the predetermined "setting value" and the value that is a reference for the ejecting process of the tablet Tb by the ejecting device 60 may be a value indicating a continuous quantity in accordance with the "detection value". For example, it may be the "time length", the "distance", the "clock number", and the "encoder pulse number". When the detection value, etc. for control is the "distance", an error in time due to the stretch of the carrying belt 21 can be eliminated, and a further precise control can be made to printing, etc.

(4) As for the ejection by the ejecting device 60 and the collection by the collecting device 70, the tablet Tb with an appearance defect, the tablet Tb with a printing defect, and the tablet Tb not printed because of the posture defect, and the tablet Tb determined as to be ejected since being carried in contact with another tablet may be individually distinguished, ejected, and collected. That is, the collecting trays are prepared for the respective tablets Tb, and when the tablet comes to the position corresponding to respective collecting tray, the ejecting device 60 may eject such a tablet. Moreover, all of these tablets Tb may be collected in the same collecting tray. Alternatively, those tablets may be sorted in accordance with subsequent process. For example, the appearance defect has a possibility of a false determination due to inadequate inspection precision, such a tablet is not immediately disposed, but a re-inspection is performed thereon. Moreover, printing defect also has a possibility of a false inspection. In such cases, those tablets may be sorted and re-inspection may be performed on each sorted tablet, or those tablets may be collected and re-inspection may be collectively performed on these tablets by a single inspecting device. Moreover, when it is known that the inspection precision is high, the tablets may be disposed without re-inspection. Furthermore, the tablets Tb determined as to be ejected because of the posture defect and two or more tablets Tb carried in contact with each other may be collectively collected and re-used. A sorting may be made in combination of those schemes.

(5) The above embodiment has been described for the tablet printing apparatus S that performs printing on the one surface of the tablet Tb. According to the present disclosure, however, the carrying device, the sensor, the camera, the printing mechanism, the ejecting device, the collecting device, and the storing device all employing the structure as described above may be added so that the tablet printing apparatus S can achieve is the structure capable of performing printing on both surfaces of the tablet Tb. In this case, at the position where the non-defective product on the carrying device 20 is removed, instead of the storing device 80, the added carrying device receives the non-defective product in a way that the other surface of the non-defective product is to be printed. Moreover, the added sensor, camera, printing mechanism, ejecting device, collecting device, and storing device perform printing on the other surface, collection of the defective product, storing of the non-defective product as described above.

Moreover, the ejecting device, the collecting device, and the storing device may be provided only for the added carrying device, and the defective product and the non-defective product may be collected at the added carrying device. In this case, the tablet Tb supplied to the carrying device 20 is not ejected, but directly fed to the added carrying device. The determination result at the carrying device 20 is also applied to the tracking of the tablet Tb at the added carrying device.

(6) In the embodiment, as for the large and small determination on the various setting value, the matching and the mismatching determination, etc., the setting for determination is optional to include the value as being equal to or greater than or equal to or smaller than, or to exclude the value being greater than, above, exceeding, smaller than, lower than, and less than.

(7) In the embodiment, although the reflective type optical sensor such as a laser sensor is applied as the sensor 30, but the beam shape of the laser is not limited to any particular shape. For example, a spot beam or a line beam may be adopted. Moreover, an image sensor such as a line sensor is also applicable. When the line sensor is applied, instead of performing image processing, when, for example, information indicating brightness includes an output exceeding a predetermined threshold, the output signal for detecting the presence and absence of the tablet Tb is changed to ON. In addition, light other than laser is also applicable, and ultrasound may be applied. Various sensors are applicable as long as the tablet Tb on the carrying belt 21 is detectable.

(8) In the embodiment, although the conditions of the tablet Tb, such as crack, chipping, and dirt, are checked from the image imaged by the camera 40, it is not always necessary to perform the condition check on the tablet Tb. Moreover, the condition check on the tablet Tb may be performed using the imaging unit provided separately from the camera 40. For example, the condition check may also be performed by the printing checking camera 52 or a camera completely and differently provided. When the condition check on the tablet Tb is performed after the printing, the determination reference for determining the tablet Tb that is printable by the printing head 51 does not include the appearance condition, such as crack, chipping, dirt of the tablet Tb.

(9) In the embodiment, although the description has been given of the inkjet printing device, the printing unit 50 is not limited to any particular type as long as it can perform printing on the tablet Tb at various timings in a non-contact manner, and for example, a laser printer is also applicable.

(10) In the embodiment, although the drying unit 53 is provided, as long as the drying during the carriage is possible, it is not always necessary to provide the drying unit 53.

(11) The structure of the supplying device 10 and the feeding scheme are not limited to those in the above embodiment as long as the tablet Tb can be supplied to the carrying device 20.

(12) Although the embodiment of the present disclosure and the modified example of each component have been described above, such embodiment and modified example of each component are merely presented as examples, and are not intended to limit the scope of the present disclosure. These above described novel embodiments can be carried out in other various forms, and various omissions, replacements, and modifications can be made thereto without departing from the scope of the present disclosure. Such embodiments and modified forms thereof are within the scope of the present disclosure, and also within the scope of the invention as recited in the appended claims.

REFERENCE SIGNS LIST

10 Supplying device
11 Hopper
12 Vibration feeder
14 Aligning feeder
16 Transfer feeder
20 Carrying device
21 Carrying belt
22 Drive pulley
23 Tension pulley
24*a*, 24*b* Adjustment pulley
25 Sucking chamber
26 Air communication hole
27 Encoder
30 Sensor
40 Camera
50 Printing unit
51 Printing head
52 Printing checking camera
53 Drying unit
60 Ejecting device
61, 62 Air blowing nozzle
70 Collecting device
71, 72 Collecting tray
80 Storing device
90 Control device
91 Mechanism control unit
92 Signal generating unit
93 Defect determining unit
94 Ejection determining unit
95 Ejection calculating unit
96 Tracking unit
97 Memory unit
98 Input and output control unit
99*a* Output device

99*b* Input device

S Tablet printing apparatus

Tb Tablet

The invention claimed is:

1. A tablet printing apparatus comprising:

a carrying device that carries tablets;

a detecting unit that detects the tablet being carried by the carrying device;

a printing unit that performs printing on the tablets; and a collecting unit that distinguishes and collects, when the detecting unit detects that two or more tablets in contact with each other are carried, a preceding tablet and a following tablet following thereto among two or more tablets.

2. The tablet printing apparatus according to claim 1, comprising an ejection determining unit that determines the following tablet following the preceding tablet as the tablet to be ejected, wherein the collecting unit comprises an ejecting device that ejects the tablet determined as the tablet to be ejected by the ejection determining unit.

3. The tablet printing apparatus according to claim 2, wherein the ejection determining unit determines a tablet with a detection value detected by the detection unit exceeding a predetermined setting value as a tablet to be ejected.

4. The tablet printing apparatus according to claim 3, comprising:

an imaging unit that images the tablet being carried by the carrying device; and a setting value determining unit that determines the setting value based on image data imaged by the imaging unit.

5. The tablet printing apparatus according to claim 2, comprising an ejection calculating unit that obtains, based on the detection value of the detecting unit, a reference value for a process of ejecting the tablet by the ejecting device.

6. The tablet printing apparatus according to claim 2, comprising an ejection calculating unit that calculates, based on the detection value of the detecting unit, a number of the tablets to be ejected by the ejecting device.

7. The tablet printing apparatus according to claim 2, comprising:

an imaging unit that images the tablet being carried by the carrying device at least either before or after the printing by the printing unit; and a defect determining unit that determines whether the tablet is a defective product or not based on image data imaged by the imaging unit, wherein the collecting unit comprises a collecting device that distinguishes and collects the tablet determined to be ejected by the ejection determining unit, a non-defective product that is printed properly, and the tablet determined as a defective product by the defect determining unit.

8. A tablet manufacturing method comprising:

performing printing, by a printing unit, on the tablets carried by a carrying unit; and detecting the tablets carried by the carrying unit by a detecting unit, wherein when the detecting unit detects that two or more tablets in contact with each other are carried, a preceding tablet and a following tablet following thereto among two or more tablets are distinguished and collected.

9. The tablet manufacturing method according to claim 8, wherein a tablet with a detection value detected by the detection unit exceeding a predetermined setting value is determined as a tablet to be ejected by an ejection determining unit.

10. The tablet manufacturing method according to claim 9, comprising:

imaging the tablet carried by the carrying unit; and determining the setting value based on imaged image data.

* * * * *